US010626584B2

(12) United States Patent
Yoshino et al.

(10) Patent No.: US 10,626,584 B2
(45) Date of Patent: Apr. 21, 2020

(54) WATER DISCHARGE DEVICE

(71) Applicant: TOTO LTD., Kitakyushu-shi, Fukuoka (JP)

(72) Inventors: Shunji Yoshino, Kitakyushu (JP); Ryohei Yaita, Kitakyushu (JP); Kiyotake Ukigai, Kitakyushu (JP); Shumpei Mio, Kitakyushu (JP)

(73) Assignee: TOTO LTD., Kitakyushu-shi, Fukuoka (JP)

( * ) Notice: Subject to any disclaimer, the term of this patent is extended or adjusted under 35 U.S.C. 154(b) by 0 days.

(21) Appl. No.: 15/879,347

(22) Filed: Jan. 24, 2018

(65) Prior Publication Data

US 2018/0216326 A1 Aug. 2, 2018

(30) Foreign Application Priority Data

Jan. 31, 2017 (JP) ..... 2017-015770

(51) Int. Cl.
*E03C 1/084* (2006.01)
*E03C 1/08* (2006.01)
(Continued)

(52) U.S. Cl.
CPC ..... *E03C 1/084* (2013.01); *B01F 3/0451* (2013.01); *B01F 5/0693* (2013.01); *B05B 1/18* (2013.01);
(Continued)

(58) Field of Classification Search
CPC ..... B01F 3/0451; B01F 5/0693; B01F 2215/0052; E03C 1/0408; E03C 1/08;
(Continued)

(56) References Cited

U.S. PATENT DOCUMENTS 966,180 A * 8/1910 Durbrow ..... B01D 21/0012 137/545
2,176,498 A * 10/1939 Hickman ..... B01D 3/10 138/38

(Continued)

FOREIGN PATENT DOCUMENTS

CN 1429304 A 7/2003
CN 202921443 U 5/2013

(Continued)

*Primary Examiner* — Darren W Gorman
*Assistant Examiner* — Steven M Cernoch
(74) *Attorney, Agent, or Firm* — BakerHostetler

(57) ABSTRACT

Provided is a water discharge device for spraying water having transparency throughout a long distance. The present invention is a water discharge device (2) that sprays the supplied water, and includes a water discharge device body (6), a rectifying chamber (14*a*) which is provided in the water discharge device body, a plurality of rectifying members (18) that are disposed at intervals in the rectifying chamber and includes a number of fine holes (18*a*), so that water sequentially passes through the plurality of rectifying members, a water spray member (20) provided with spray nozzles (22*b*) for discharging the water passing through these rectifying members, and an air bubble discharge flow path (26) that is formed so that air bubbles present among the rectifying members bypass at least one of the rectifying members to reach the water spray member, and has a larger flow path sectional area than the fine holes.

12 Claims, 14 Drawing Sheets

(51) Int. Cl.

| | |
|---|---|
| ***B05B 1/18*** | (2006.01) |
| ***E03C 1/04*** | (2006.01) |
| ***B01F 3/04*** | (2006.01) |
| ***B01F 5/06*** | (2006.01) |
| ***E03C 1/14*** | (2006.01) |
| ***B05B 7/04*** | (2006.01) |

(52) U.S. Cl.
CPC ..... *E03C 1/0404* (2013.01); *E03C 1/0408* (2013.01); *E03C 1/08* (2013.01); *E03C 1/14* (2013.01); *B01F 2215/0052* (2013.01); *B05B 7/0425* (2013.01)

(58) Field of Classification Search
CPC ..... E03C 1/14; E03C 1/0404; E03C 1/084; B05B 1/18; B05B 7/0425; B01D 35/04; B01D 35/043; B01D 35/046
USPC ..... 137/545, 801; 210/449
See application file for complete search history.

(56) References Cited

U.S. PATENT DOCUMENTS 2,754,097 A * 7/1956 Hjulian ..... E03C 1/084 210/198.1
2,819,049 A * 1/1958 Kaemmerlen, Jr. ... B01D 3/205 202/158
2,998,933 A * 9/1961 Aghnides ..... B01F 3/0473 239/428.5
3,279,702 A * 10/1966 Aghnides ..... E03C 1/084 239/427
3,524,591 A * 8/1970 Samuels ..... E03C 1/084 239/428.5
3,633,824 A * 1/1972 Aghnides ..... E03C 1/084 239/428.5
4,211,368 A * 7/1980 Legros ..... A01C 23/042 239/315
4,346,844 A * 8/1982 Harmony ..... B05B 1/1636 239/381
4,637,552 A * 1/1987 Finkbeiner ..... E03C 1/084 239/428.5
4,733,818 A * 3/1988 Aghnides ..... B05B 7/0425 239/428.5
5,143,295 A * 9/1992 Okayama ..... B05B 3/04 239/403
5,309,946 A * 5/1994 Ligneul ..... F15D 1/02 138/39
5,327,941 A * 7/1994 Bitsakis ..... B01F 5/0682 138/42
6,152,182 A 11/2000 Grether et al.
6,270,022 B1 * 8/2001 Knapp ..... B05B 7/0425 239/428.5
6,708,902 B2 * 3/2004 Takeshi ..... B05B 7/005 239/428.5
7,217,362 B2 * 5/2007 Hsiao ..... B01D 35/04 137/801
7,878,426 B2 * 2/2011 Denzler ..... E03C 1/084 239/398
7,997,299 B2 * 8/2011 Lee ..... H01M 8/04029 137/545
2004/0089597 A1 * 5/2004 Hsu ..... B01D 35/046 210/232
2005/0189289 A1 9/2005 Hsiao
2008/0272212 A1 * 11/2008 Denzler ..... E03C 1/0404 239/428.5
2011/0240767 A1 * 10/2011 Kitaura ..... E03C 1/084 239/428.5
2011/0284662 A1 * 11/2011 Ohashi ..... A47K 3/28 239/428.5
2012/0018661 A1 * 1/2012 Kao ..... E03C 1/0412 251/359
2012/0160925 A1 * 6/2012 Hoisington ..... B41J 2/14233 239/1
2012/0234943 A1 * 9/2012 Ukigai ..... B05B 1/08 239/428.5
2015/0204058 A1 * 7/2015 Grether ..... E03C 1/084 239/428.5

FOREIGN PATENT DOCUMENTS

DE 202011108020 U1 * 11/2011 ..... B01D 35/046
JP S56-159476 U 11/1981
JP H11-93231 A 4/1999
JP H11-172731 A 6/1999
JP 2001-327426 A 11/2001
JP 3769558 B 4/2006
JP 2015014173 A 1/2015

* cited by examiner

WATER DISCHARGE DEVICE

BACKGROUND OF THE INVENTION

Field of the Invention

The present invention relates to a water discharge device, and particularly relates to a water discharge device that discharges supplied water to shower the water.

Description of the Related Art

Japanese Patent No. 5168708 describes a shower device. In the shower device, supplied water flows into a casing, and the water flowing therein passes through a rectifying net disposed in the casing. The water that is rectified by the rectifying net is discharged from a plurality of spray holes provided in a spray plate disposed at a downstream side of the rectifying net, and is discharged to shower.

However, in an ordinary shower device like the shower device described in Japanese Patent No. 5168708, the water which is discharged to shower is not sufficiently rectified, so that linear water flows that are discharged do not have transparency, and are split into fine water droplets in a short distance after discharged from the spray holes. With water discharge like this, sufficient quality cannot be obtained in the water flows discharged from the shower device, and a sense of high luxuriousness, a feeling of quietness and a feeling of comfortable use cannot be obtained.

Accordingly, the present invention has an object to provide a water discharge device with which water flows which are discharged have sufficient transparency, linear flows are kept throughout a long distance after discharge, and a sense of sufficiently high luxuriousness, a feeling of high quality wash and quiet water flows can be obtained.

SUMMARY OF THE INVENTION

In order to solve the aforementioned problem, the present invention is a water discharge device for spraying water, and includes a water discharge device body; a rectifying chamber provided in the water discharge device body to which the water is introduced; a plurality of rectifying members each having a plurality of holes, the rectifying members being disposed at intervals in the rectifying chamber so that the water passes through the rectifying members; a water spray member provided with a plurality of spray nozzles for discharging the water passing through the rectifying members; and an air bubble discharge flow path having cross section larger than each of the holes of the rectifying members, the air bubble discharge flow path is provided so that air bubbles which are larger than the holes of the rectifying members and are present between the rectifying members, are discharged from spaces between the rectifying members; wherein the intervals between the rectifying members are larger than the holes of the rectifying members, and the air bubbles in the spaces between the rectifying members flow through the air bubble discharge flow path and reach to the water spray member.

In the present invention configured like this, the supplied water flows into the rectifying chamber provided in the water discharge device body. The plurality of rectifying members including the plurality of holes are disposed in the rectifying chamber, the water flowing therein passes through the plurality of rectifying members disposed in the rectifying chamber, and is discharged as shower discharge water from the plurality of spray nozzles provided in the water spray member.

In order to obtain a linear water flow with high quality which is sufficiently rectified, the present inventor firstly tried to dispose a plurality of rectifying members in the rectifying chamber. However, even the plurality of rectifying members to pass through are adopted, sufficient rectification was not able to be obtained. The present inventor who considered that the cause thereof is air bubbles staying in the rectifying chamber, tried to discharge air that stayed in the rectifying chamber before water discharge was started. However, even though a sufficient time elapsed after start of the water discharge, and the air staying in the rectifying chamber at the initial time was sufficiently discharged, the present inventor still was not able to obtain linear water flows with sufficient rectification.

As the result that the present inventor continued the earnest study in order to find out the cause, the present inventor found that sufficient rectification was not obtained because the air dissolved into water was eluted in the rectifying chamber to form air bubbles, even when the air staying in the rectifying chamber at the initial time was discharged. That is, the air dissolved into water was eluted in a portion of the rectifying member, and the air grew into large air bubbles to generate a disturbance in the flow of the water in the rectifying chamber, so that a disturbance occurred to the water flow. This problem occurs when any water is discharged, but was remarkable in the case of discharging water having a higher temperature in which the dissolved air is easily eluted.

According to the present invention configured as described above, the plurality of rectifying members are disposed at the intervals larger than the holes, and the air bubble discharge flow path which is formed to allow the space between the rectifying member and the rectifying member in the plurality of rectifying members, and the water spray member to communicate with each other, so that even when large air bubbles are generated in the rectifying chamber, the large air bubbles can be discharged. Consequently; the linear water flows discharged from the respective spray nozzles have extremely high rectification, and are kept to be linear throughout a long distance after discharge. As a result, when the water discharge device of the present invention is used as the water discharge device for hand washing and a kitchen, transparent shower water flow which is kept to be linear has a unique pleasant feeling when hitting fingers and the like, and a high quality wash feeling can be obtained when used in hand washing and dishwashing.

In the present invention, it is preferable that the air bubble discharge flow path is provided at an upper side of the rectifying members so that air bubbles in the space between the rectifying members reach to the air bubble discharge flow path by a buoyant force.

According to the present invention configured in this way, the air bubble discharge flow path is provided at the upper side of the rectifying members, so that the air bubbles which are present between the rectifying members can be guided to the air bubble discharge flow path by a buoyant. That is, the air bubbles which are present between the rectifying member and the rectifying member in the plurality of rectifying members can be guided to a different direction from the water flow by the buoyant. As a result, it becomes possible to cause the air bubbles which are present between the rectifying member and the rectifying member in the plurality of rectifying members to reach the air bubble discharge flow path quickly, and discharge the air bubbles to outside of the rectifying chamber. This can restrain occurrence of a disturbance to the water flow by the disturbance occurring to the flow of the water in the rectifying chamber by large air bubbles in the rectifying chamber.

In the present invention, it is preferable that the air bubble discharge flow path is formed in each of the rectifying members disposed at a downstream side in the rectifying chamber and at least one of the rectifying members disposed at an upstream side in the rectifying chamber does not have the air bubble discharge flow path.

The air bubble discharge flow path can efficiently discharge the air bubbles that are generated in the rectifying members, but the flow path sectional area thereof is larger than the fine holes of the rectifying members, so that the flow velocity of the water flowing in the air bubble discharge flow path becomes high, and the rectifying performance is likely to be reduced. According to the present invention configured as described above, the air bubble discharge flow path is formed in all of the rectifying members disposed at the downstream side, out of the plurality of rectifying members, and the air bubble discharge flow path is not formed in at least one of the rectifying members disposed at the upstream side, out of the plurality of rectifying members, so that the air bubble discharge flow path can be shortened, and reduction in the rectifying performance due to increase in the flow velocity can be restrained. Further, at least one of the rectifying members at the upstream side is not provided with the air bubble discharge flow path, but because it is at the upstream side, the influence of the generated air bubbles on the flow of the water which is to be jetted is small. Thereby, high rectifying performance and restraint on growth of the air bubbles can be made compatible.

In the present invention, it is preferable that a buffer space is further provided between one of the rectifying members disposed at a most downstream side and the water spray member and a downstream end of the air bubble discharge flow path communicates with the buffer space.

According to the present invention configured in this way, the buffer space is provided between the rectifying member at the most downstream side and the water spray member, and the downstream end of the air bubble discharge flow path communicates with the buffer space, so that the flow velocity of the water flowing in the air bubble discharge flow path can be decelerated in the buffer space. This can restrain reduction in the rectifying performance as a result of providing the air bubble discharge flow path, and it becomes possible to jet a more transparent and beautiful water flow.

In the present invention, it is preferable that a collision surface is provided in the buffer space, and the water flown from the air bubble discharge flow path collides with the collision surface.

According to the present invention configured in this way the collision surface is provided in the buffer space, and the water flowing in from the air bubble discharge flow path collides with the collision surface, so that the flow velocity of the water flowing in the air bubble discharge flow path can be reduced.

In the present invention, it is preferable that each of the spray nozzles is formed into a taper shape in which a cross section of the spray nozzles is narrowed toward a downstream side.

According to the present invention configured in this way, the respective spray nozzles are each configured into the taper shape in which the flow path sectional area becomes smaller toward the downstream side, so that the flow path sectional area at the inflow side of each of the spray nozzles can be made large. Consequently, the air bubbles included in the water can be easily passed, and it can be made difficult for air bubbles to stay at the upstream side of the water spray member.

According to the water discharge device of the present invention, the water flows which are discharged have sufficient transparency, linear flows are kept throughout a long distance after discharge, a linear flow is kept throughout a long distance after discharge, and a sense of sufficiently high luxuriousness, a feeling of high quality wash, and a quiet water flow can be obtained.

DETAILED DESCRIPTION OF THE PREFERRED EMBODIMENT

Next, with reference to the accompanying drawings, a water discharge device according to an embodiment of the present invention will be described.

Figure 1:
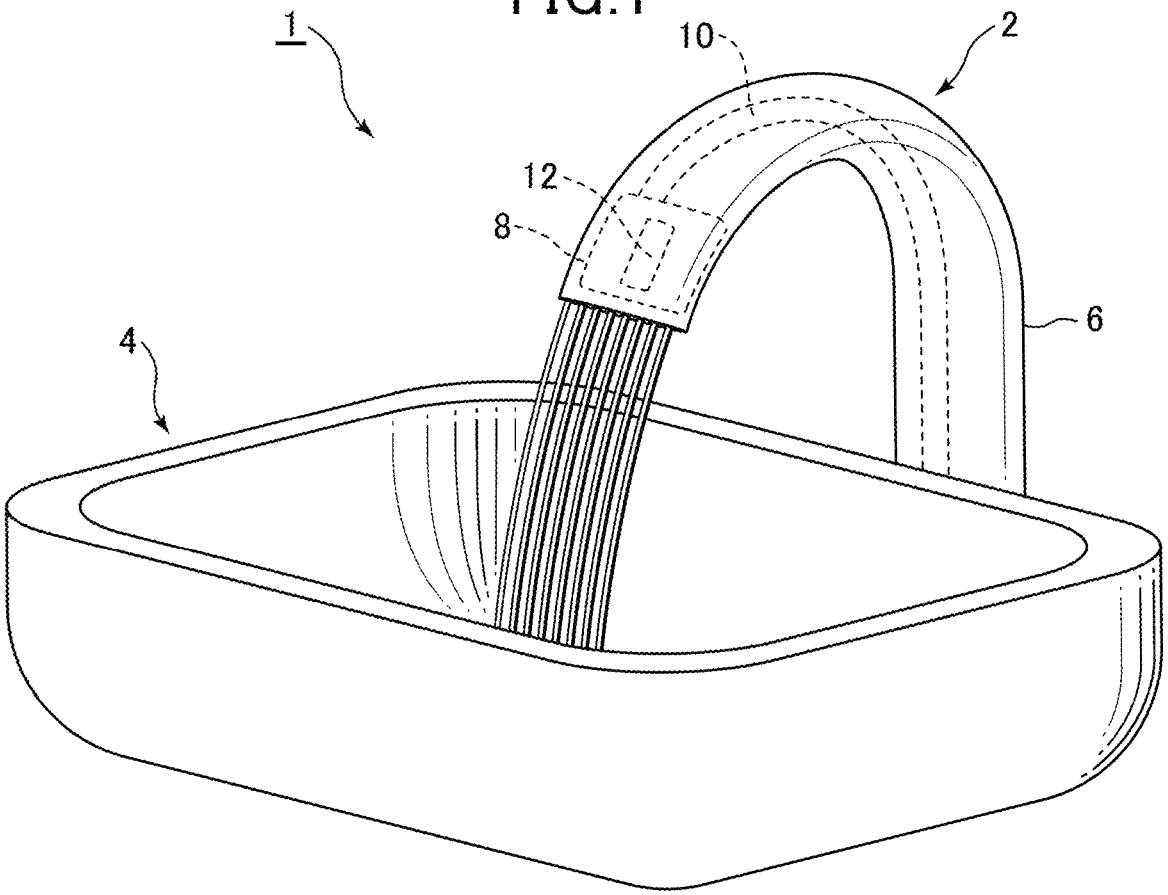
FIG. 1 is a perspective view illustrating an entire hand washer including a water discharge device according to an embodiment of the present invention.

FIG. 1 is a perspective view illustrating an entire hand washer including the water discharge device according to the embodiment of the present invention.

As illustrated in FIG. 1, a hand washer 1 has a water discharge device 2 according to the embodiment of the present invention, and a washbowl 4 that receives water that is discharged from the water discharge device 2.

The water discharge device 2 has a water discharge device body 6 in which a water discharge portion is provided at a distal end, a rectifying device 8 contained in a distal end portion of the water discharge device body 6, a water supply pipe 10 that supplies water to the rectifying device 8, and a human body detection sensor 12 contained in the distal end portion of the water discharge device body 6.

The water discharge device body 6 is a tubular member of a metal with a substantially elliptical section, and bends forward in an arch shape after being raised substantially vertically from a mounting surface, and the distal end portion provided with the water discharge section is directed substantially downward.

The water discharge device 2 of the present embodiment is configured in this way, so that when a user puts out fingers and the like under the water discharge portion, the human body detection sensor 12 senses this, and a control device (not illustrated) housed in a lower part of the washbowl 4 causes an electromagnetic valve (not illustrated) to open. Thereby, water is supplied to the rectifying device 8 via the water supply pipe 10, and water that is rectified in the rectifying device 8 is discharged to be showered from the distal end of the water discharge device body 6. According to the water discharge device 2 of the present embodiment, shower water that is discharged is in a linear water flow with extremely high transparency, and a beautiful linear form is kept until the shower water reaches the washbowl 4.

Figure 2:
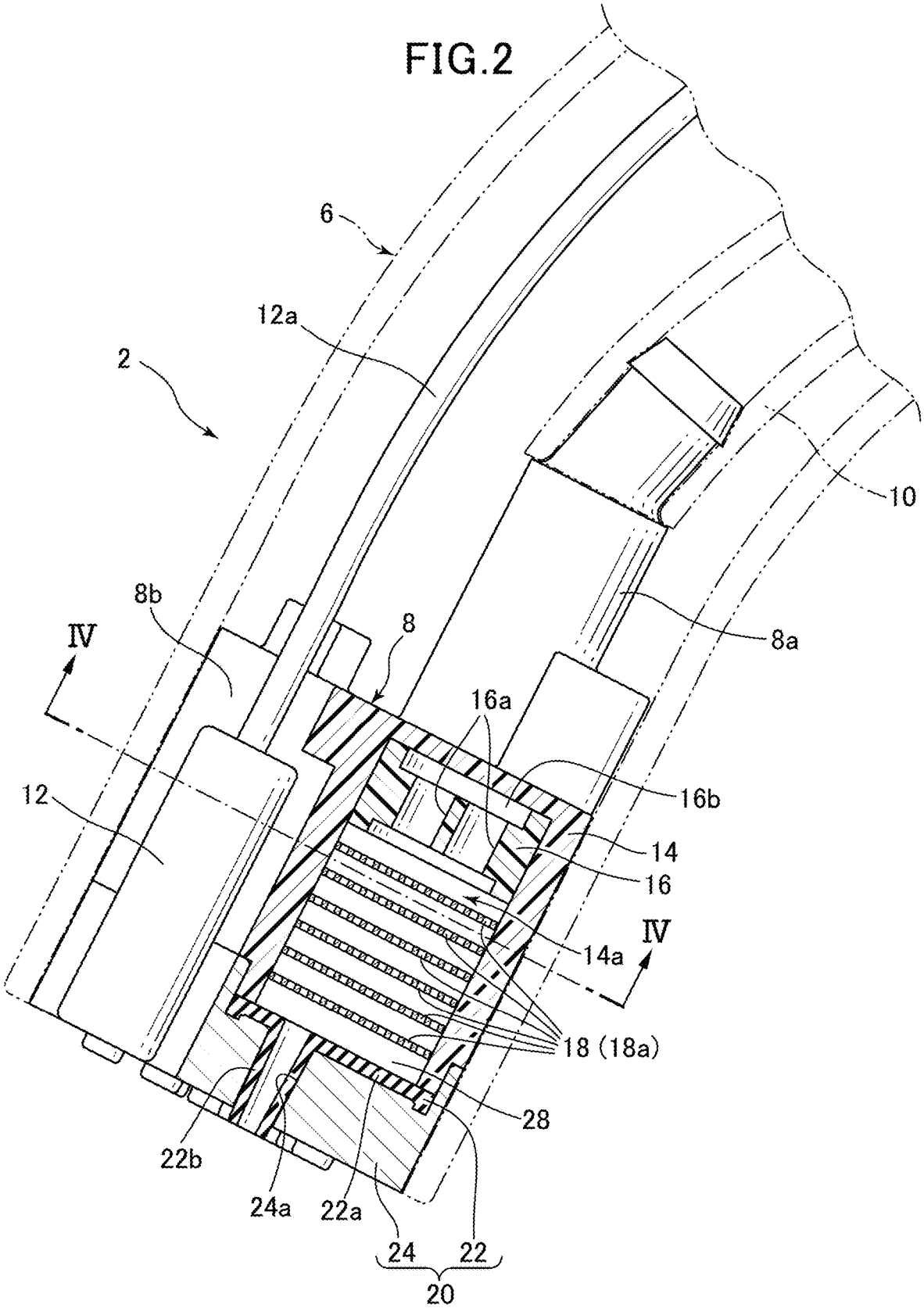
FIG. 2 is a sectional side view of the discharge device according to the embodiment of the present invention, and illustrates an enlarged distal end portion.
Figure 3:
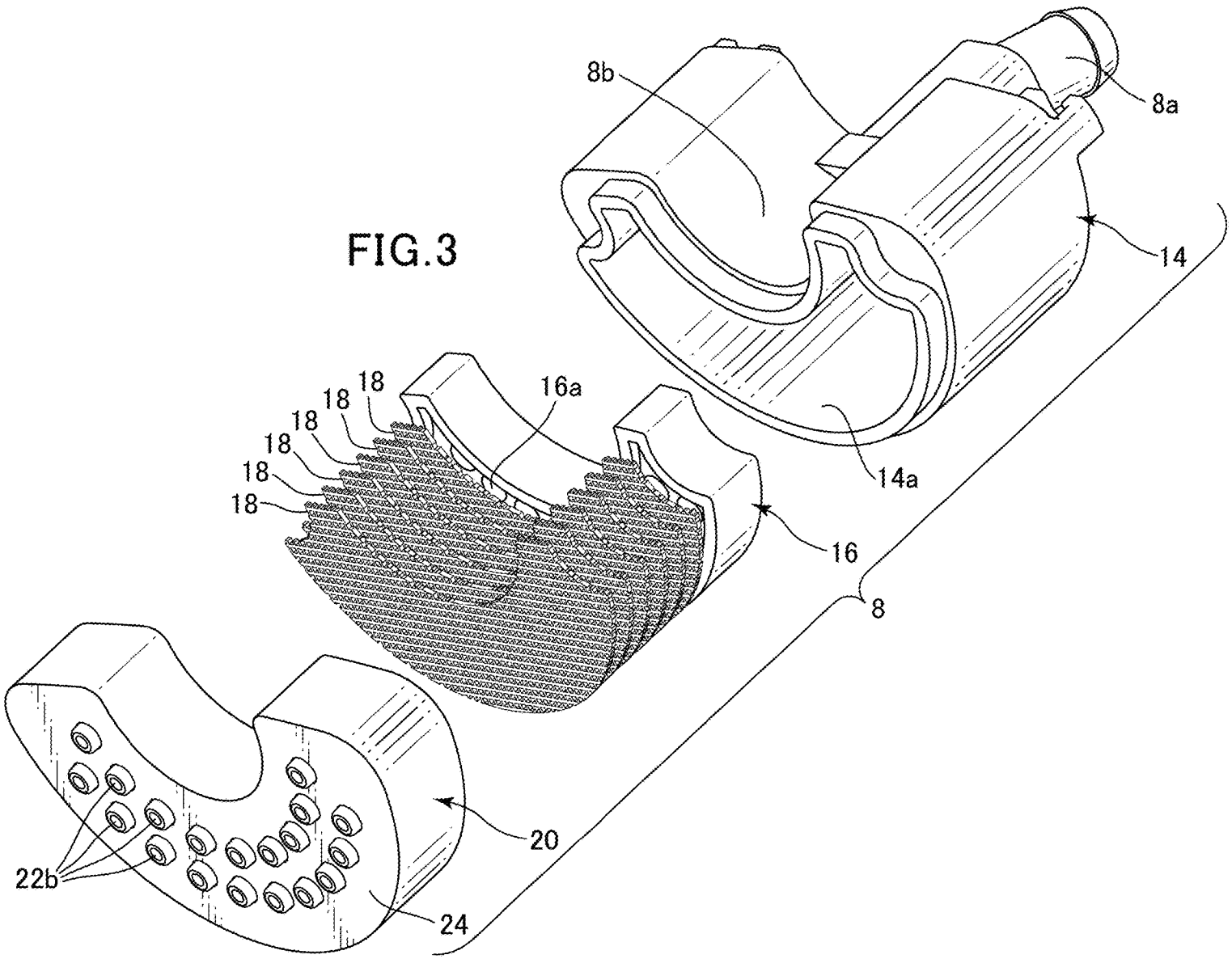
FIG. 3 is an exploded perspective view of a rectifying device contained in the distal end portion of the water discharge device according to the embodiment of the present invention.
Figure 4:
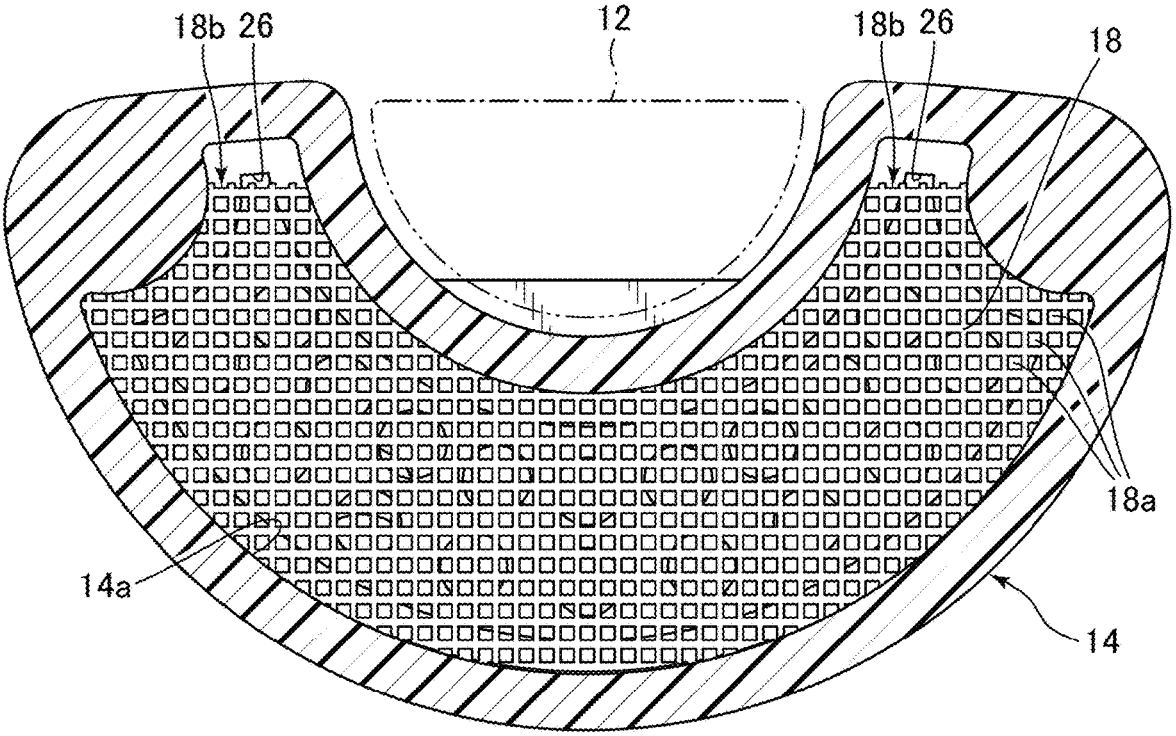
FIG. 4 is a sectional view taken along line IV-IV in FIG. 2.

Next, referring to FIGS. 2 to 4 newly, an internal structure of the water discharge device 2 of the embodiment of the present invention will be described. FIG. 2 is a sectional side view of the water discharge device 2, and illustrates an enlarged distal end portion. FIG. 3 is an exploded perspective view of the rectifying device 8 contained in the distal end portion of the water discharge device 2. FIG. 4 is a sectional view taken along line IV-IV in FIG. 2.

As illustrated in FIG. 2, to the distal end portion of the water discharge device body 6, the rectifying device 8 which is constructed into a shape corresponding to a shape of a distal end opening portion thereof is attached. A water supply pipe connection portion 8*a* is provided at a rear end portion of the rectifying device 8, and the water supply pipe 10 is connected to the water supply pipe connection portion 8*a*. Further, the human body detection sensor 12 is disposed in a recessed portion 8*b* (FIG. 3) on an outer periphery of the rectifying device 8, and from the human body detection sensor 12, a signal line 12*a* for transmitting a detection signal to a control unit (not illustrated) extends. In the present embodiment, the human body detection sensor 12 is an infrared-ray type sensor that emits infrared rays, and detects an object to be detected by receiving the infrared rays reflected from the object to be detected.

As illustrated in FIG. 3, the rectifying device 8 has a rectifying device body 14, a flow distributing plate 16 housed in the rectifying device body 14, six meshes 18 that are rectifying members disposed at a downstream side of the flow distributing plate 16 and formed into plate shapes, and a water spray member 20 that is disposed at a downstream side of these meshes 18 and is provided with a plurality of spray nozzles.

The rectifying device body 14 is a resin member in which a rectifying chamber 14*a* having a section that is bent substantially in an arc shape is provided inside, and the water supply pipe connection portion 8*a* is formed in a rear end portion thereof. Thereby, water that is supplied through the water supply pipe 10 and the water supply pipe connection portion 8*a* flows inside of the rectifying chamber 14*a*. Further, a front end portion of the rectifying device body 14 is opened, and through the opening portion, the flow distributing plate 16 and the respective meshes 18 are disposed inside the rectifying chamber 14*a*. The rectifying chamber 14*a* has a substantially constant flow path section from an upstream end to a downstream end, and has the flow distributing plate 16 and the six meshes 18 disposed inside.

The flow distributing plate 16 is a plate-shaped resin member that is formed into a shape that corresponds to a sectional shape of the rectifying chamber 14*a*, and a plurality of through-holes 16*a* (FIG. 2) are formed in such a manner as to penetrate through a plate surface of the flow distributing plate 16. Water that is supplied from the water supply pipe 10 flows into a space 16*b* at an upstream side of the flow distributing plate 16, in the rectifying chamber 14*a*. Here, the water supply pipe 10 is connected to a position eccentric to a center of the rectifying chamber 14*a*, so that the flow in the space 16*b* at the upstream side of the flow distributing plate 16 is deviated, but by being given a proper flow path resistance by the flow distributing plate 16, a flow of the water passing through the flow distributing plate 16 becomes substantially uniform. That is, by passing through the flow distributing plate 16, the flow in the rectifying chamber 14*a* is caused to have a substantially uniform flow velocity in each part in a flow path section, and a flow rate distribution of water that reaches the meshes 18 at the downstream side of the flow distributing plate 16 is made uniform.

The mesh 18 is a flat wire mesh formed by weaving elemental wires of a stainless steel vertically and laterally, and the six meshes are disposed at predetermined intervals from one another so that the water flowing into the rectifying chamber 14*a* sequentially passes through the meshes. That is, the respective meshes 18 are disposed substantially perpendicularly to a direction of the water flow in the rectifying chamber 14*a* and parallel with one another (FIG. 2). In the present embodiment, the mesh 18 is a wire net of a three-dimensional mesh structure of 60 meshes (a net where 60 elemental wires are disposed parallel vertically and laterally in one inch) that is woven by the stainless steel elemental wires of a wire diameter of 180 μm. Thereby, a large number of fine holes 18*a* each having a size of approximately 0.24 mm in length and width (spaces between the elemental wires in FIG. 4) are formed in the mesh 18. The mesh 18 in which dimensions in a vertical direction and a lateral direction of the fine hole 18*a* are approximately 0.1 to 1.0 mm is preferably used. Further, the respective meshes 18 are disposed at intervals larger than the size of the fine hole 18*a*, and in the present embodiment, the respective meshes 18 are disposed at intervals of approximately 2 mm. The respective meshes 18 are preferably disposed at intervals of 0.5 to 5.00 mm. Further, hydrophilic treatment is applied to the respective meshes 18, and the hydrophilic treatment that is applied to the meshes 18 will be described later.

The water spray member 20 is a member provided with a plurality of spray nozzles for discharging the water passing through the respective meshes 18. In the present embodiment, as illustrated in FIG. 2, the water spray member 20 is composed of a rubber nozzle forming member 22 that is an elastic member, and a nozzle support member 24 in which a plurality of spray holes that receive respective spray nozzles provided in the nozzle forming member 22 is formed.

As a modification example, a water spray nozzle is formed by providing a plurality of through-holes in a plate-shaped member, and the water spray nozzle can be used as the water spray member.

The nozzle forming member 22 is a rubber member in which a flat plate portion 22*a* in a thin plate shape, and a plurality of water spray nozzles 22*b* formed to protrude in a discharge direction of water from the flat plate portion 22*a* are formed integrally with each other. The flat plate portion 22*a* is a plate-shaped portion formed into a shape corresponding to the open portion at the distal end of the rectifying device body 14, and by sandwiching a periphery of the rubber flat plate portion 22*a* between the distal end of the rectifying device body 14 and the nozzle support member 24, water tightness of the rectifying chamber 14*a* is ensured. The respective water spray nozzles 22*b* are cylindrical portions that are raised substantially perpendicularly from the flat plate portion 22*a*, and in each of the water spray nozzles 22*b*, a nozzle hole formed into a taper shape so that a flow path sectional area becomes smaller toward the distal end is formed.

The nozzle support member 24 is a plate-shaped member that is formed to close the open portion in the distal end of the rectifying device body 14, and spray holes 24*a* are respectively provided in positions that match the respective spray nozzles 22*b* provided in the nozzle forming member 22. In a state in which the rectifying device 8 is assembled, the respective spray nozzles 22*b* of the nozzle forming member 22 are respectively received in the spray holes 24*a* of the nozzle support member 24, and distal end portions of the respective spray nozzles 22*b* slightly protrude from the nozzle support member 24.

Next, with reference to FIG. 4, a bubble discharge flow path formed in the rectifying chamber 14*a* will be described.

FIG. 4 is a sectional view illustrating a state in which the mesh 18 is disposed in the rectifying chamber 14*a* of the rectifying device body 14. As described above, the mesh 18 is formed into the shape corresponding to the flow path sectional shape of the rectifying chamber 14*a*, and therefore a peripheral edge of the mesh 18 and an inner wall surface of the rectifying chamber 14*a* abut on each other throughout a substantially entire perimeter. However, end portions at both sides of the mesh 18 are slightly cut out, and in cutout portions 18*b* thereof, the peripheral edge of the mesh 18 and the inner wall surface of the rectifying chamber 14*a* do not abut on each other. Accordingly, in portions where the mesh 18 is cut out, water in the rectifying chamber 14*a* can flow to a downstream side of the mesh 18 without passing through the fine holes 18*a* of the mesh 18. Air bubbles included in the water can also flow to the downstream side through the cutout portions 18*b* of the mesh 18. That is, by providing the cutout portions 18*b* at the end portions at both sides of the mesh 18, two gaps are formed between the inner wall surface of the rectifying chamber 14*a* and the cutout portions 18*b* at both sides, and these gaps function as two air bubble discharge flow paths 26 that can cause air bubbles to bypass the mesh 18 and flow to a downstream side.

In the present embodiment, the cutouts of the mesh 18 are provided in all of the six meshes 18, so that the two air bubble discharge flow paths 26 are formed to communicate with a downstream side of the flow distributing plate 16 to the water spray member 20. Further, in the present embodiment, a flow path sectional area of each of the air bubble discharge flow paths 26 is formed to be larger than an area of each of the fine holes 18*a* of the mesh 18 (the mesh 18 in FIG. 4 is illustrated schematically, and the size of the fine hole 18*a* differs from an actual scale).

Further, as illustrated in FIG. 2, a space in the rectifying chamber 14*a*, between the mesh 18 disposed at a most downstream side of the six meshes 18 and the water spray member 20 functions as a buffer space 28, and upstream ends of the two air bubble discharge flow paths 26 respectively communicate with the buffer space 28.

Next, with reference to FIG. 5, the hydrophilic treatment which is applied to the mesh 18 will be described.

Figure 5:
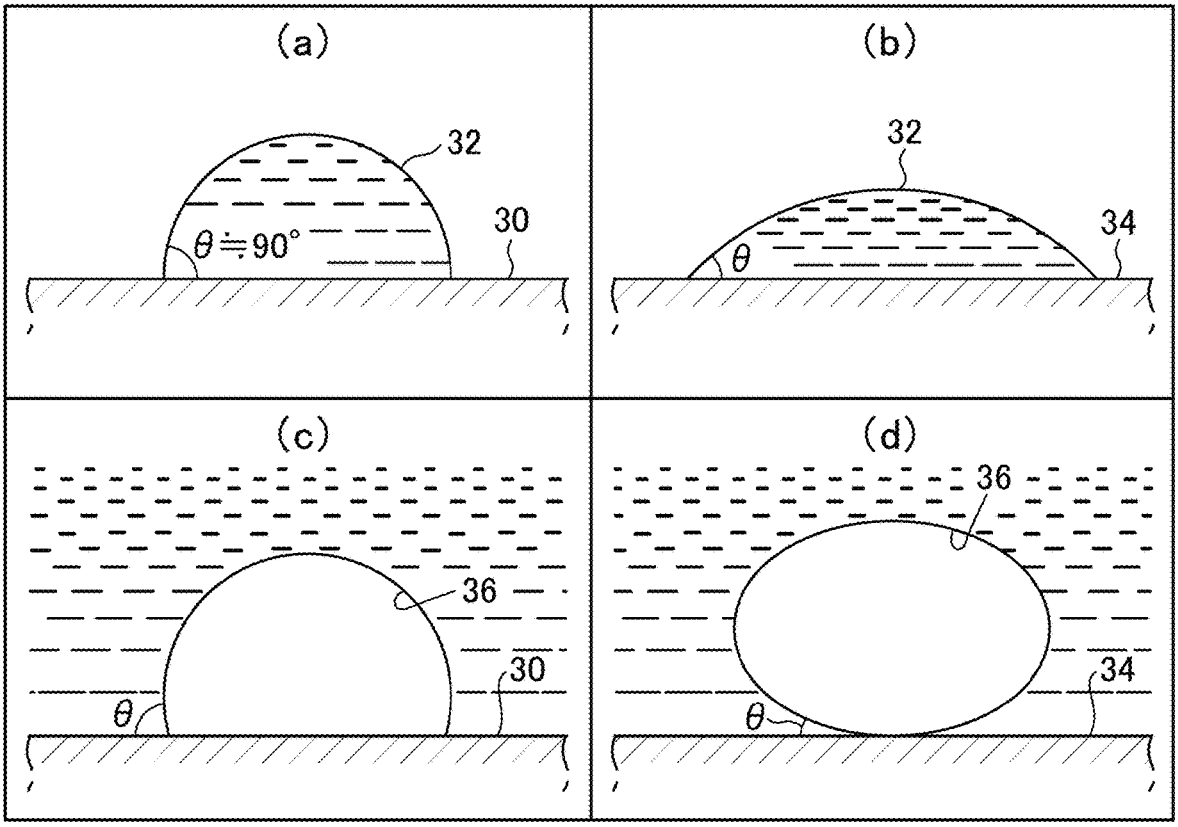
FIG. 5 is a view schematically illustrating a state where a water droplet adheres to a plate of a stainless steel, and a state where an air bubble adheres.

FIG. 5 is a view schematically illustrating states where water droplets adhere to a plate of a stainless steel, and states air bubbles adhere thereto. Column (a) in FIG. 5 shows a state where a water droplet 32 adheres to a stainless steel plate 30 to which the hydrophilic treatment is not applied, and column (b) shows a state where the water droplet 32 adheres to a stainless steel plate 34 to which the hydrophilic treatment is applied. Further, column (c) in FIG. 5 shows a state where an air bubble 36 adheres to the stainless steel plate 30 in water to which the hydrophilic treatment is not applied, and column (d) shows a state where the air bubble 36 adheres to the stainless steel plate 34 to which the hydrophilic treatment is applied.

As shown in column (a) in FIG. 5, the water droplet 32, which adheres to the stainless steel plate 30 to which the hydrophilic treatment is not applied, forms a contact angle θ of approximately 90° to the stainless steel plate 30. In contrast with this, as shown in column (b) in FIG. 5, in the stainless steel plate 34 to which the hydrophilic treatment is applied, the contact angle θ formed by the adhering water droplet 32 is smaller than 90°, and the flatter water droplet is formed. That is, by applying the hydrophilic treatment to the stainless steel plate, the water droplet spreads more widely on the stainless steel plate, and forms a small contact angle.

As shown in column (c) in FIG. 5, when the air bubble 36 adheres to the stainless steel plate 30 which is sunken in water and to which the hydrophilic treatment is not applied, the contact angle θ between the water and the stainless steel plate 30 becomes approximately 90°, so that the dome-shaped air bubble 36 is formed on the stainless steel plate 30. In contrast with this, when the air bubble 36 adheres to the stainless steel plate 34 which is sunken in the water and to which the hydrophilic treatment is applied, as shown in column (d) in FIG. 5, hydrophilicity of the stainless steel plate 34 is high, and the contact angle θ between the water and the stainless steel plate 34 becomes small, so that water significantly wraps around under a lower side of the air bubble 36. Consequently, the air bubble 36 that adheres to the stainless steel plate 34 to which the hydrophilic treatment is applied is in a shape close to a sphere, and the adhering bubble 36 is easily removed from the stainless steel plate 34.

In the present embodiment, the hydrophilic treatment is applied to the respective meshes 18 formed from elemental wires of a stainless steel, so that the air bubbles adhering to the respective meshes 18 in the rectifying chamber 14*a* are easily removed from the meshes 18. As the hydrophilic treatment for enhancing hydrophilicity of the member, there are cited a mechanical method of forming microscopic asperities on the surface of the member by blasting treatment or the like, and a chemical method of applying coating or the like onto the surface of the member. The hydrophilic treatment is applied to the respective meshes 18 so that the contact angle preferably becomes approximately 1° to 50°, more preferably approximately 1° to 20°.

Next, with reference to FIGS. 6 to 12, an operation of the water discharge device according to the embodiment of the present invention will be described.

FIGS. 6 to 12 are views schematically illustrating an inside of the rectifying chamber 14*a* of the rectifying device 8 at a time of use of the water discharge device 2.

Figure 6:
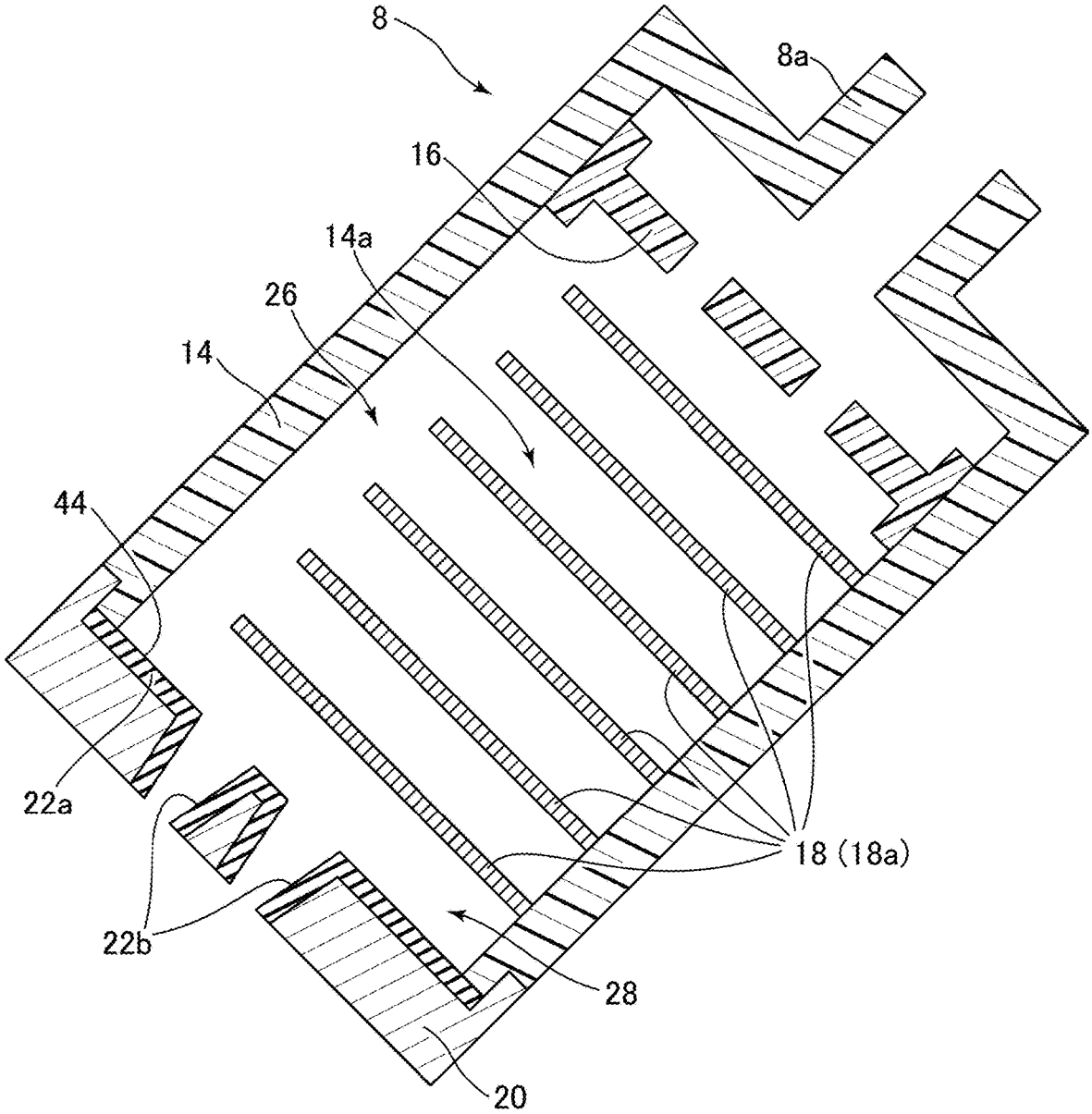
FIG. 6 is a view schematically illustrating an inside of a rectifying chamber before start of initial use of the water discharge device, in order to describe an operation of the water discharge device according to the embodiment of the present invention.

As illustrated in FIG. 6, before start of initial use of the water discharge device 2, the inside of the rectifying chamber 14*a* of the rectifying device 8 is filled with air.

Figure 7:
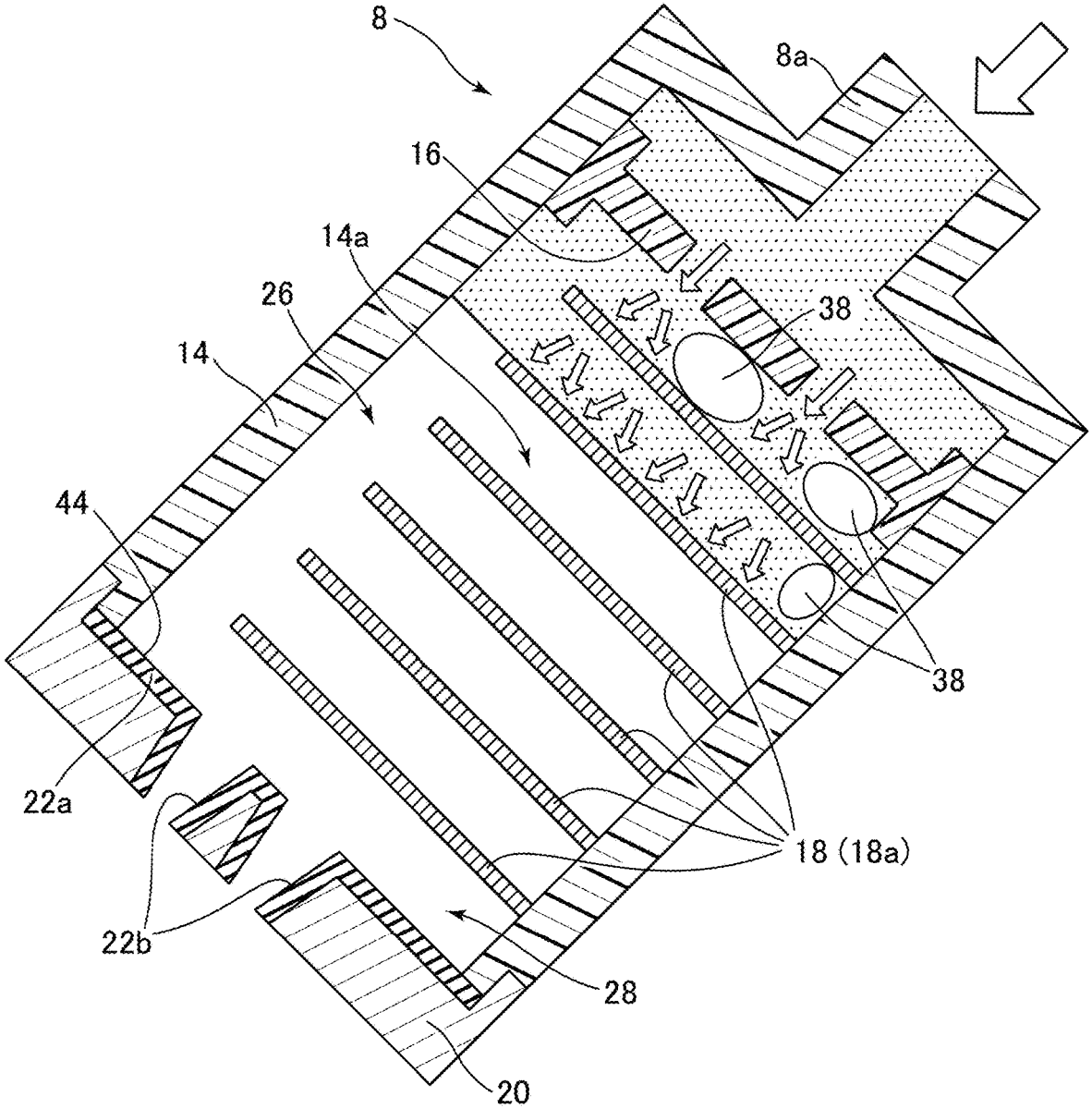
FIG. 7 is a view schematically illustrating the inside of the rectifying chamber immediately after start of water supply to the discharge device, in order to describe the operation of the water discharge device according to the embodiment of the present invention.

Next, as illustrated in FIG. 7, when water is supplied to the rectifying device 8 to start water discharge from the water discharge device 2, water flows into the rectifying chamber 14*a* from the water supply pipe connection portion 8*a*. In the water flowing into the rectifying chamber 14*a*, a flow velocity distribution is made uniform by the flow distributing plate 16. That is, when the water flows into the rectifying chamber 14*a* from the water supply pipe connection portion 8*a*, an eddy existing in the water is fragmented by the flow distributing plate 16, and is close to a uniform flow. Further, the water passing through the flow distributing plate 16 sequentially passes through the six meshes 18 disposed at the downstream side of the flow distributing plate 16 from an upstream side and is rectified. Further, a part of the water passing through the flow distributing plate 16 flows to the downstream side through the air bubble discharge flow paths 26 that are formed by cutting out parts of the meshes 18. At this time, most of the air present in the rectifying chamber 14*a* is pushed outside the rectifying chamber 14*a* through the spray nozzle 22*b* by the water flowing into the rectifying chamber 14*a*. However, a part of the existing air stays in a stagnant region where the flow of the water is slow in the rectifying chamber 14*a*, and forms air bubbles 38 there by residual air.

Figure 8:
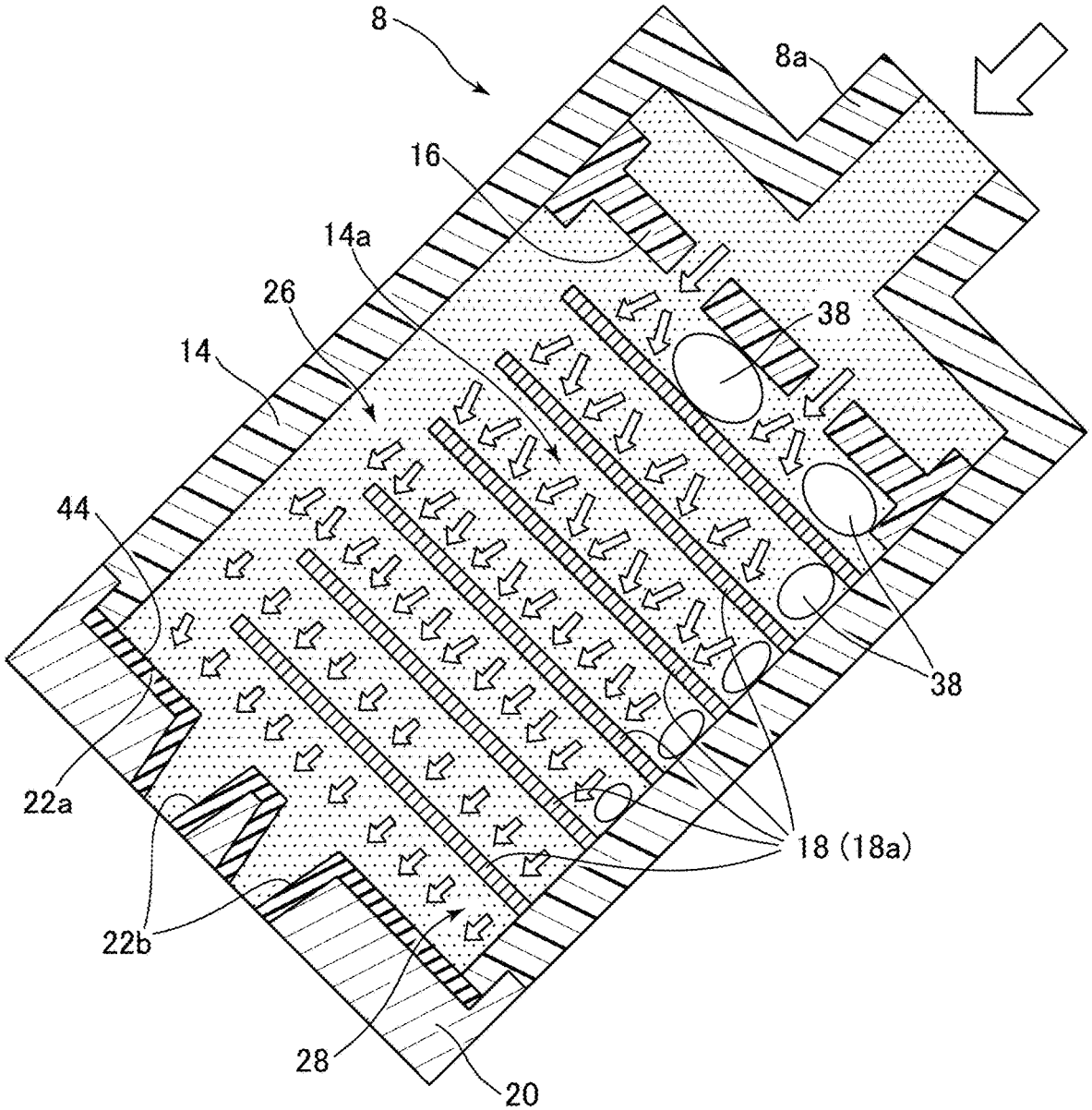
FIG. 8 is a view schematically illustrating the inside of the rectifying chamber at the time of initial water discharge of the water discharge device, in order to describe the operation of the water discharge device according to the embodiment of the present invention.

Next, as illustrated in FIG. 8, when the water flowing into the rectifying chamber 14*a* reaches the water spray member 20, water is jetted from the respective spray nozzles 22*b*. The water reaching the water spray member 20 is sufficiently rectified by the six meshes 18, and vectors of flows are uniformized to a high degree. The water passing through the mesh 18 at the most downstream side flows into the buffer space 28 which is a relatively wide space between the mesh 18 at the most downstream side and the water spray member 20 and is further decelerated, and a disturbance of the flow is reduced. Consequently, the water that is jetted from the respective spray nozzles 22*b* forms linear flows with extremely high rectification and high transparency, which are not fragmented into water droplets until the water reaches the washbowl 4. Note that as illustrated in FIG. 8, the air bubbles 38 by residual air also stay even in this state, and remain without being discharged outside of the rectifying chamber 14*a*.

Figure 9:
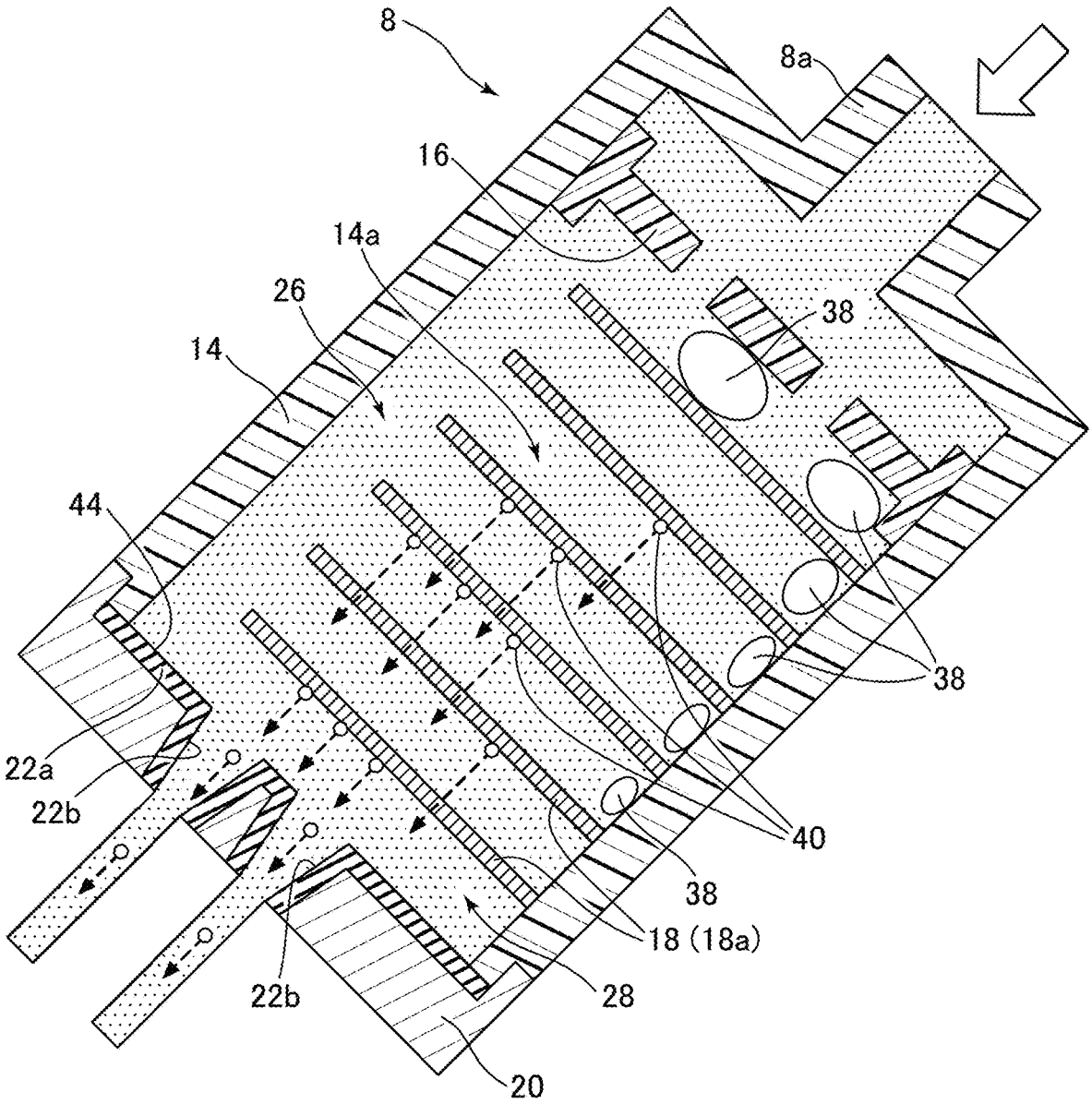
FIG. 9 is a view schematically illustrating the inside of the rectifying chamber in the initial water discharge of the water discharge device, in order to describe the operation of the water discharge device according to the embodiment of the present invention.

Further, as illustrated in FIG. 9, when water discharge by the water discharge device 2 is continued, air dissolved into water forms fine air bubbles 40 when the air passing through the mesh 18, apart from the air staying in the rectifying chamber 14*a*. However, since the hydrophilic treatment is applied to the respective meshes 18, and the air bubbles 40 hardly adhere to the mesh 18 as described above, the generated fine air bubbles 40 are removed from the mesh 18 quickly. The air bubbles 40 which are generated in the mesh 18 are extremely small immediately after the air bubbles 40 are generated, so that the fine air bubbles 40 which are removed from the mesh 18 quickly pass through the fine holes 18*a* of the respective meshes 18 to be discharged from the spray nozzles 22*b*. The fine air bubbles 40 like them are extremely small, and therefore hardly affect the transparency of the flow of the water which is jetted from the spray nozzles 22*b*.

Each of the spray nozzles 22*b* is formed into a taper shape in which a flow path sectional area becomes smaller toward the downstream side, so that each of the spray nozzles has a flow path sectional area at an inflow side made larger with respect to an outflow side. Consequently, the air bubbles included in the water easily flows into each of the spray nozzles 22*b*, and air bubbles hardly stay in the buffer space 28 at an upstream side of the water spray member 20. Thereby, the air bubbles staying in the buffer space 28 can be restrained from growing to be large air bubbles, and an influence of the air bubbles on the water flow to be jetted can be restrained.

Figure 10:
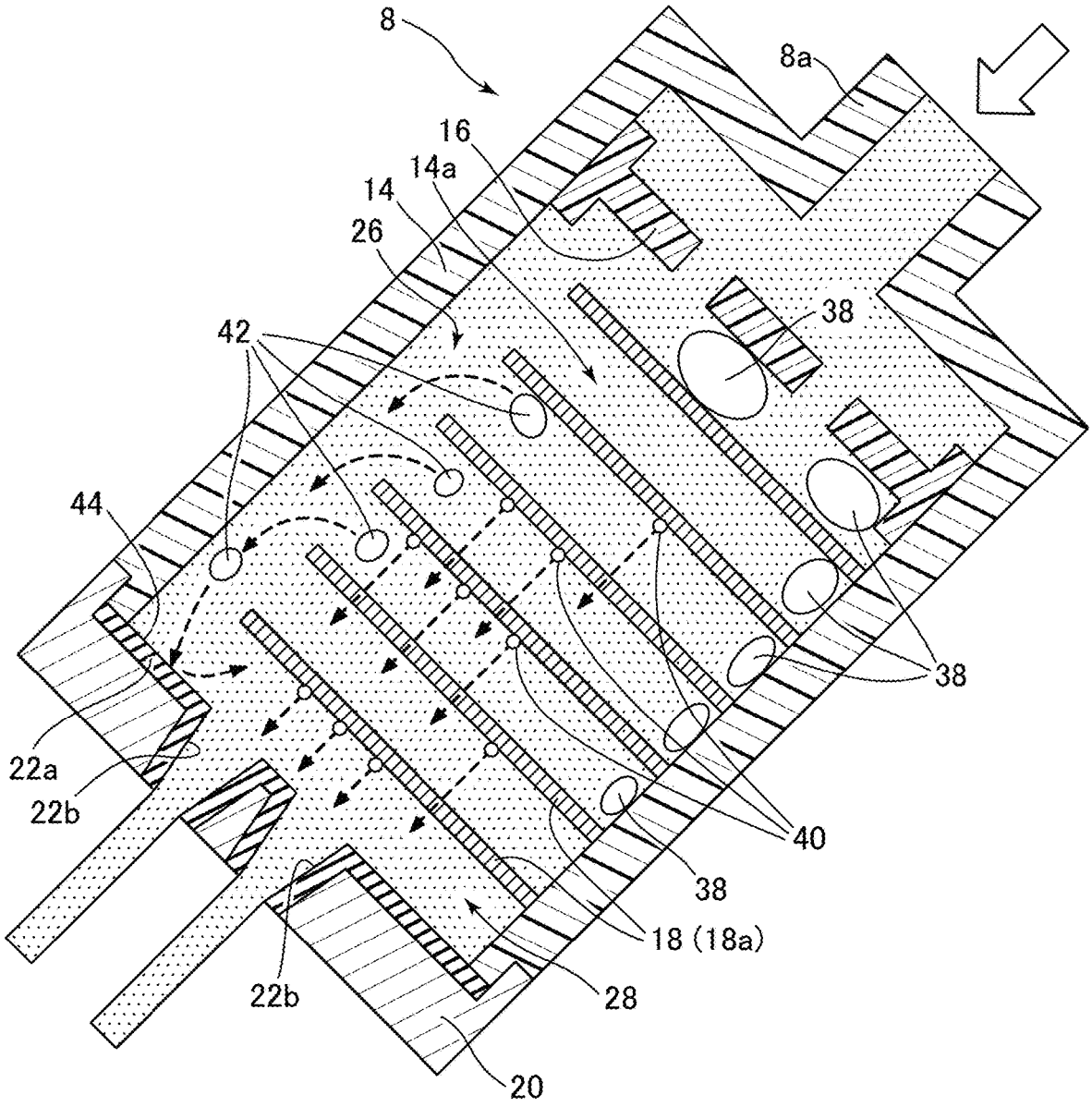
FIG. 10 is a view schematically illustrating the inside of the rectifying chamber in the initial water discharge of the water discharge device, in order to describe the operation of the water discharge device according to the embodiment of the present invention.

Further, as illustrated in FIG. 10, when the fine air bubbles 40 generated in the mesh 18 adhere to the mesh 18 for some time, the fine air bubbles 40 are bonded to fine air bubbles 40 that are newly generated in the same spot, and grow into slightly larger air bubbles 42. That is, when air bubbles are difficult to remove from the mesh 18 and a time period in which the air bubbles adhere to the mesh 18 becomes long, the fine air bubbles 40 which are generated easily grow to be large air bubbles. Or, even when air bubbles are made easy to remove by applying hydrophilic treatment to the mesh 18, fine air bubbles that are removed from the mesh 18 bond to one another, and grow to be a slightly larger air bubbles 42. The grown air bubbles 42 cannot pass through the fine holes 18*a* of the mesh 18 any more, and remain in the spaces among the respective meshes 18. However, the respective meshes 18 are disposed by being inclined with respect to the vertical direction, and therefore the grown air bubbles 42 move upward in the spaces among the respective meshes 18 by a buoyancy. Since the air bubble discharge flow paths 26 are provided at upper parts of the spaces among the respective meshes 18, so that the grown air bubbles 42 which are moved upward bypass the respective meshes 18 and pass through the air bubble discharge flow paths 26 to flow to the downstream side in the rectifying chamber 14*a*.

Further, in the rectifying chamber 14*a*, a part where the respective meshes 18 are disposed has high flow path resistance, so that a flow velocity is relatively low, whereas parts corresponding to the air bubble discharge flow paths 26 provided by cutting out the respective meshes 18 have relatively low flow path resistance, so that the flow velocity becomes high. Consequently, in the rectifying chamber 14*a*, the parts corresponding to the air bubble discharge flow paths 26 have lower pressure than the part where the respective meshes 18 are disposed, and the grown air bubbles 42 are also moved toward the air bubble discharge flow paths 26 by a pressure difference thereof.

Here, as illustrated in FIG. 10, a downstream end of the air bubble discharge flow path 26 reaches the water spray member 20, but the spray nozzle 22*b* is not provided in a portion facing the air bubble discharge flow path 26, of the water spray member 20. Accordingly, the water flowing in the air bubble discharge flow path 26 collides with a collision surface 44 on the water spray member 20 (the flat plate portion 22*a* of the nozzle forming member 22), and a flow velocity of the water flowing in the air bubble discharge flow path 26 decelerates due to the collision, and the water is discharged from the spray nozzle 22*b*. In this way, the water flowing in the air bubble discharge flow path 26 collides with the collision surface 44 of the water spray member 20, whereby the flow velocity of the water decelerates, and the water is discharged, so that reduction in rectifying performance by providing the air bubble discharge flow path can be restrained.

Figure 11:
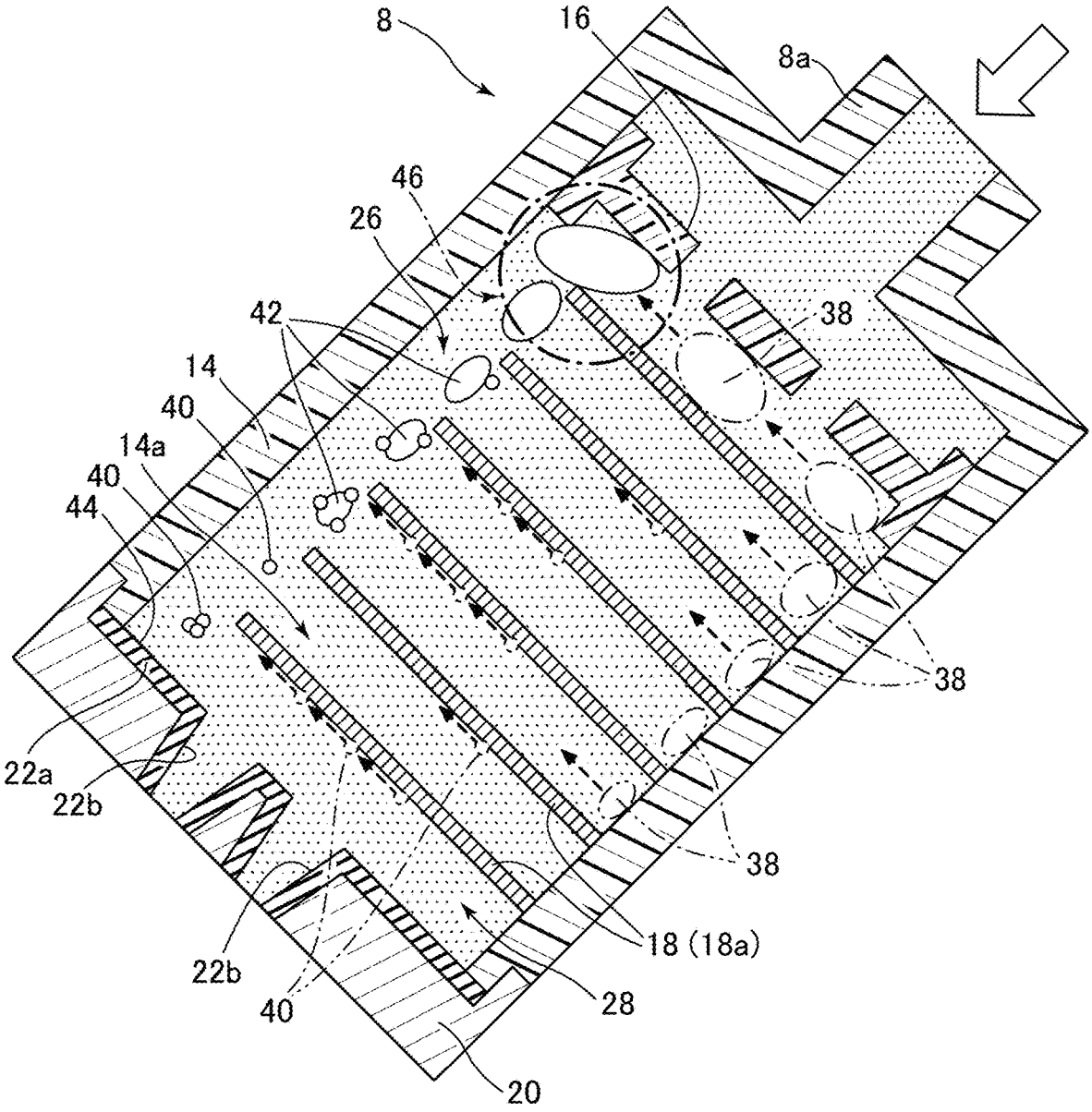
FIG. 11 is a view schematically illustrating the inside of the rectifying chamber in water stopping of the water discharge device, in order to describe the operation of the water discharge device according to the embodiment of the present invention.

Next, as illustrated in FIG. 11, when water supply to the rectifying device 8 is stopped, jetting of water from the respective spray nozzles 22*b* is also stopped. Here, the water which remains in the rectifying chamber 14*a* when water supply to the rectifying device 8 is stopped hardly flows out from the inside of the rectifying chamber 14*a* by surface tension thereof and the like, after stop of the water supply, and external air hardly flows back from the respective spray nozzles 22*b*. Further, the nozzle forming member 22 forming the spray nozzle 22*b* is made of a rubber with elasticity, so that at the time of water discharge, the spray nozzle 22*b* is elastically deformed by the pressure of jetted water, and the flow path sectional area is slightly enlarged. In contrast with this, when the water discharge is stopped, the pressure acting on the spray nozzle 22*b* is reduced, so that the flow path sectional area of the spray nozzle 22*b* becomes smaller than at the time of water discharge. Thereby, outflow of the water from the rectifying chamber 14*a* at the time of stopping water is further restrained, and backflow of the external air into the rectifying chamber 14*a* is also further restrained.

When water supply to the rectifying device 8 is stopped, the air bubbles 38 by the residual air that is pushed into the stagnant region by the flow of the water in the rectifying chamber 14*a*, the fine air bubbles 40 remaining in the spaces among the respective meshes 18, and the grown air bubbles 42 move upward in the rectifying chamber 14*a* by buoyant. Here, the respective meshes 18 are disposed by being inclined with respect to the vertical direction, so that the air bubbles among the respective meshes 18 move upward among the meshes 18 and reach the air bubble discharge flow path 26 which is located above, and the air bubbles reaching the air bubble discharge flow path 26 further move upward in the air bubble discharge flow path 26. Thereby, many air bubbles existing in the rectifying chamber 14*a* at the time of stopping water is gathered in an air bubble retention portion 46 (a highest portion in a space between the mesh 18 at the most upstream side and the flow distributing plate 16) that is located at the upstream end of the air bubble discharge flow path 26.

That is, in the present embodiment, the air bubble discharge flow path 26 is located above the respective meshes 18, and the rectifying chamber 14*a* is disposed to be directed diagonally downward, so that the upstream end of the air bubble discharge flow path 26 is at the highest position, and this functions as the air bubble retention portion 46. Accordingly, the air bubble retention portion 46 is formed to communicate with the air bubble discharge flow path 26. Further, for example, when the rectifying chamber is disposed to be directed diagonally upward, a downstream end (a highest portion of a space between the mesh 18 at the most downstream side and the water spray member 20) of the air bubble discharge flow path 26 becomes the air bubble retention portion. As described later, the air bubble retention portion 46 is preferably provided at a position where the gathered air bubbles can be discharged from the respective spray nozzles 22*b* without passing through the respective meshes 18 when water discharge is started next.

Figure 12:
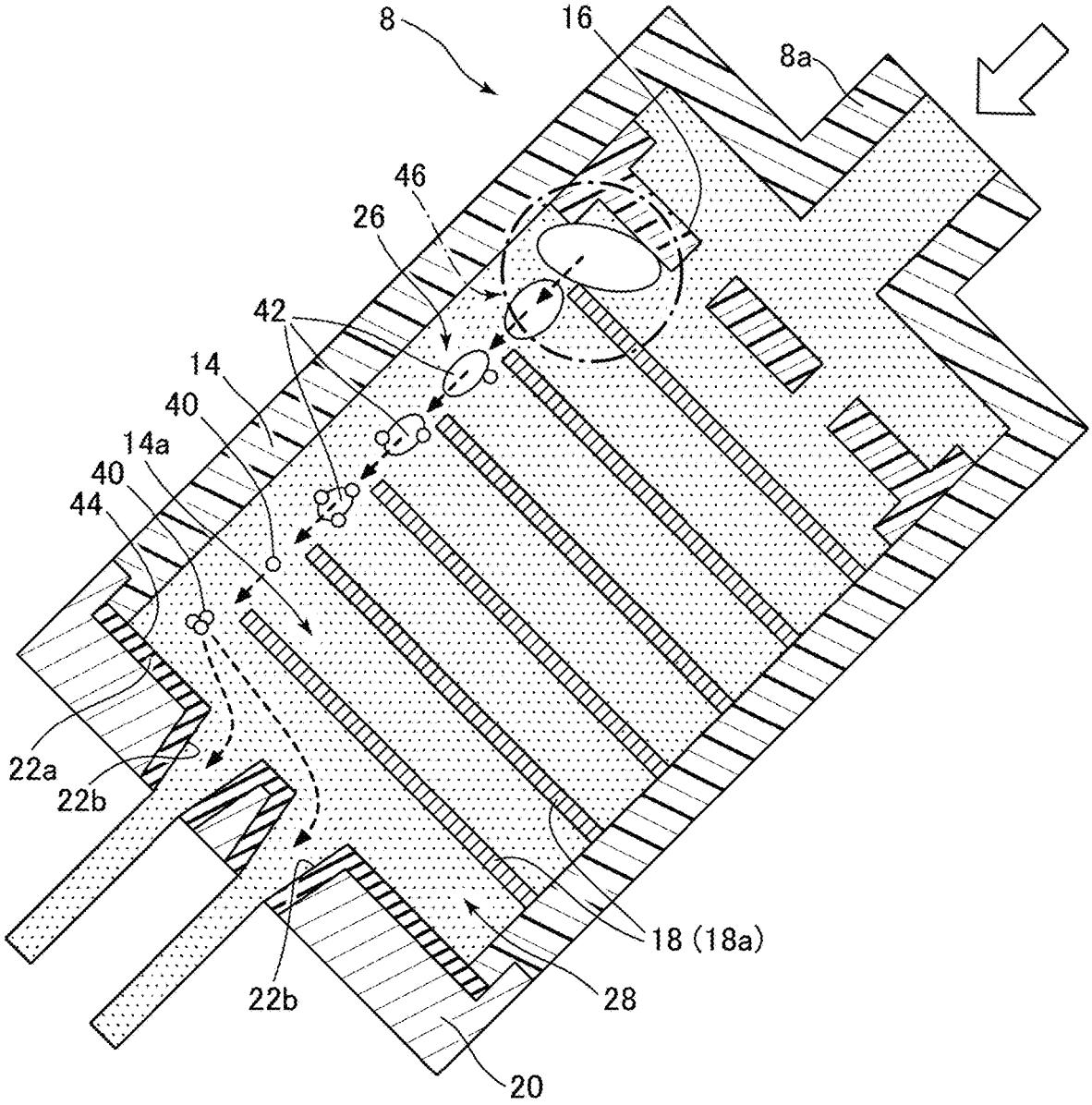
FIG. 12 is a view schematically illustrating the inside of the rectifying chamber at a time of start of second water discharge of the water discharge device, in order to describe the operation of the water discharge device according to the embodiment of the present invention.

Next, as illustrated in FIG. 12, when water supply to the rectifying device 8 is restarted, the air bubbles gathered in the air bubble retention portion 46 is forced to flow to the downstream side by new water which flows in through the flow distributing plate 16. At this time, since the air bubble retention portion 46 is located at the upstream end of the air bubble discharge flow path 26, the air bubbles gathered in the air bubble retention portion 46 is caused to flow to the downstream side through the air bubble discharge flow path 26 without passing through the fine holes 18*a* of the respective meshes 18. The flow path sectional area of the air bubble discharge flow path 26 is larger than the fine hole 18*a* of each of the meshes 18, so that the air bubbles in the air bubble retention portion 46 easily passes inside the air bubble discharge flow path 26. The air bubbles that are caused to flow in the air bubble discharge flow path 26 to the downstream end are discharged from the respective water spray nozzles 22*b*. The air bubbles in the air bubble retention portion 46 are soon finished being discharged after water discharge is started, so that beauty of the flows of the water discharged from the spray nozzles 22*b* is not significantly impaired. Further, in the following water discharge, there is substantially no air bubble 38 by residual air, so that a total amount of air bubbles discharged with water decreases, and an influence on the beauty of water flows at the time of start of water discharge further decreases.

When the rectifying chamber is disposed to be directed diagonally upward, and the highest portion of the space between the mesh 18 at the most downstream side and the water spray member 20 is the air bubble retention portion, the air bubbles staying in the air bubble retention portion are discharged from the respective spray nozzles 22*b* without passing through (the fine holes 18*a* of) the respective meshes 18.

Next, with reference to FIG. 13, a relationship between the number of meshes and the water flow of the water which is jetted will be described.

Figure 13:
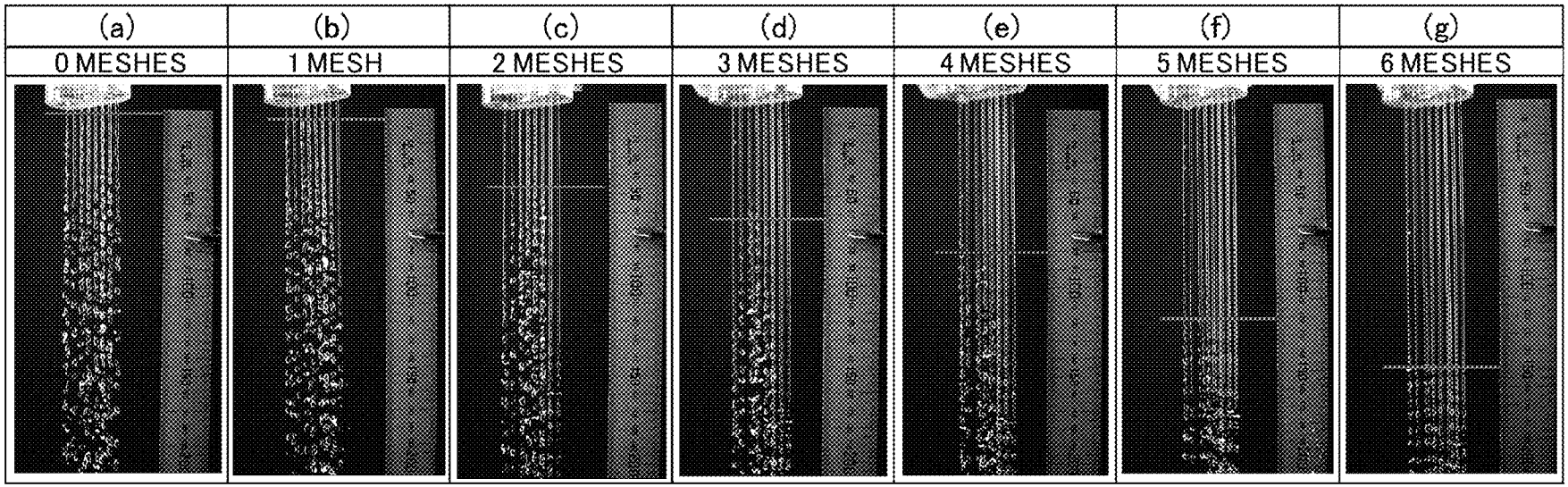
FIG. 13 is a photograph showing a change in flows that are ejected from spray nozzles in a case of changing the number of meshes disposed in the rectifying chamber.

FIG. 13 is a photograph showing changes of the flow jetted from the spray nozzle 22*b* in a case of changing the number of meshes 18 disposed in the rectifying chamber 14*a*. Column (a) in FIG. 13 shows flows in a case where the mesh 18 is not disposed in the rectifying chamber 14*a*, and column (b) in FIG. 13 shows flows in a case where the one mesh 18 is disposed in the rectifying chamber 14*a*. Hereunder, columns (c) to (g) in FIG. 13 sequentially show flows in the cases where two to six meshes 18 are disposed in the rectifying chamber 14*a*.

First, in the case where the mesh 18 is not disposed in the rectifying chamber 14*a* in column (a) in FIG. 13, water flows start to be disturbed immediately after the water is jetted from the respective spray nozzles 22*b*. Next, as shown in column (b) in FIG. 13, in the case where the one mesh 18 is disposed, the water flows start to be disturbed at a position approximately 5 mm from the respective spray nozzles 22*b*. Further, with the two meshes shown in column (c) in FIG. 13, the water flow starts to be disturbed at a position of approximately 50 mm. The water flows start to be disturbed at a position of approximately 65 mm with the three meshes shown in column (d), at a position of approximately 80 mm with the four meshes shown in column (e), at a position of approximately 120 mm with the five meshes shown in column (f), and at a position of approximately 150 mm with the six meshes shown in column (g).

That is, as in the water discharge device 2 of the embodiment of the present invention, the six meshes 18 are disposed in the rectifying chamber 14*a*, whereby linear water flows with transparency without disturbance throughout approximate 150 mm can be obtained after the water is jetted from the respective spray nozzles 22*b*. When the number of meshes in the rectifying chamber 14*a* is further increased, a distance at which the flows without a disturbance is obtained is extended, but the extension gradually decreases, and the effect of increasing the meshes is decreased. Accordingly, three to ten meshes are preferably disposed in the rectifying chamber.

According to the water discharge device 2 of the embodiment of the present invention, the plurality of meshes 18 are disposed at predetermined intervals, and the air bubble discharge flow paths 26 that are formed to bypass the meshes 18 and reach the water spray member 20 are included (FIG. 8), so that even when large air bubbles are generated in the rectifying chamber, the large air bubbles can be discharged. Consequently, linear water flows discharged from the respective spray nozzles 22*b* have extremely high rectification, and are kept to be linear throughout a long distance after discharge. As a result, when the discharge device 2 of the present embodiment is used as the discharge device for hand washing and a kitchen, the transparent shower water flows which are kept to be linear have a unique comfortable feeling when hitting fingers and the like, and when used in hand washing and dishwashing, a high-quality wash feeling can be obtained.

Further, according to the water discharge device 2 of the present embodiment, the air bubble discharge flow paths 26 are provided at an upper side of the meshes 18 (FIG. 8), so that the air bubbles existing among the meshes 18 can be guided to the air bubble discharge flow paths 26 by a buoyant. That is, the air bubbles which are present among the meshes 18 can be guided to a different direction from the water flow by the buoyant. As a result, it becomes possible to cause the air bubbles existing among the meshes 18 to reach the air bubble discharge flow paths 26 quickly and discharge the air bubbles to outside the rectifying chamber 14*a*. Thereby, occurrence of a disturbance to the water flows as a result of a disturbance occurring to the flow of the water in the rectifying chamber due to large air bubbles in the rectifying chamber can be restrained more.

Furthermore, according to the water discharge device 2 of the present embodiment, the buffer space 28 is provided between the mesh 18 at the most downstream side and the water spray member 20, and the downstream end of the air bubble discharge flow path 26 communicates with the buffer space 28, so that the flow velocity of the water flowing in the air bubble discharge flow path 26 can be decelerated in the buffer space 28. Thereby, reduction in the rectifying performance by providing the air bubble discharge flow path 26 can be restrained, and more transparent and beautiful water flows can be jetted.

Further, according to the water discharge device 2 of the present embodiment, the collision surface 44 is provided in the buffer space 28, and water flowing in from the air bubble discharge flow path 26 collides with the collision surface 44, so that the flow velocity of the water flowing in the air bubble discharge flow path 26 can be reduced.

Furthermore, according to the water discharge device 2 of the present embodiment, each of the spray nozzles 22*b* is formed into the taper shape in which the flow path sectional area becomes smaller toward the downstream side, so that the flow path sectional area at the inflow side of each of the spray nozzles 22*b* can be made larger. Consequently, the air bubbles included in the water can be easily passed, and it can be made difficult for the air bubbles to stay at the upstream side of the water spray member 20.

While the preferred embodiment of the present invention is described above, various changes can be added to the aforementioned embodiment. In particular, in the aforementioned embodiment, the six meshes 18 (the rectifying members) are disposed in the rectifying chamber 14*a*, but an arbitrary number that is two or more of rectifying members can be disposed in the rectifying chamber 14*a*. While in the aforementioned embodiment, the hydrophilic treatment is applied to all the meshes 18, but the hydrophilic treatment may be applied to only some of the rectifying members, or the hydrophilic treatment does not have to be applied. While in the aforementioned embodiment, the rectifying member is formed of a mesh (net) obtained by weaving the elemental wires of a stainless steel, rectifying members of other materials and in other forms may be also used.

While in the aforementioned embodiment, the cutout portions 18*b* are provided in all the meshes 18, and thereby the air bubble discharge flow paths 26 are formed, the cutout portions may be provided in only some of the meshes as a modification example.

Figure 14:
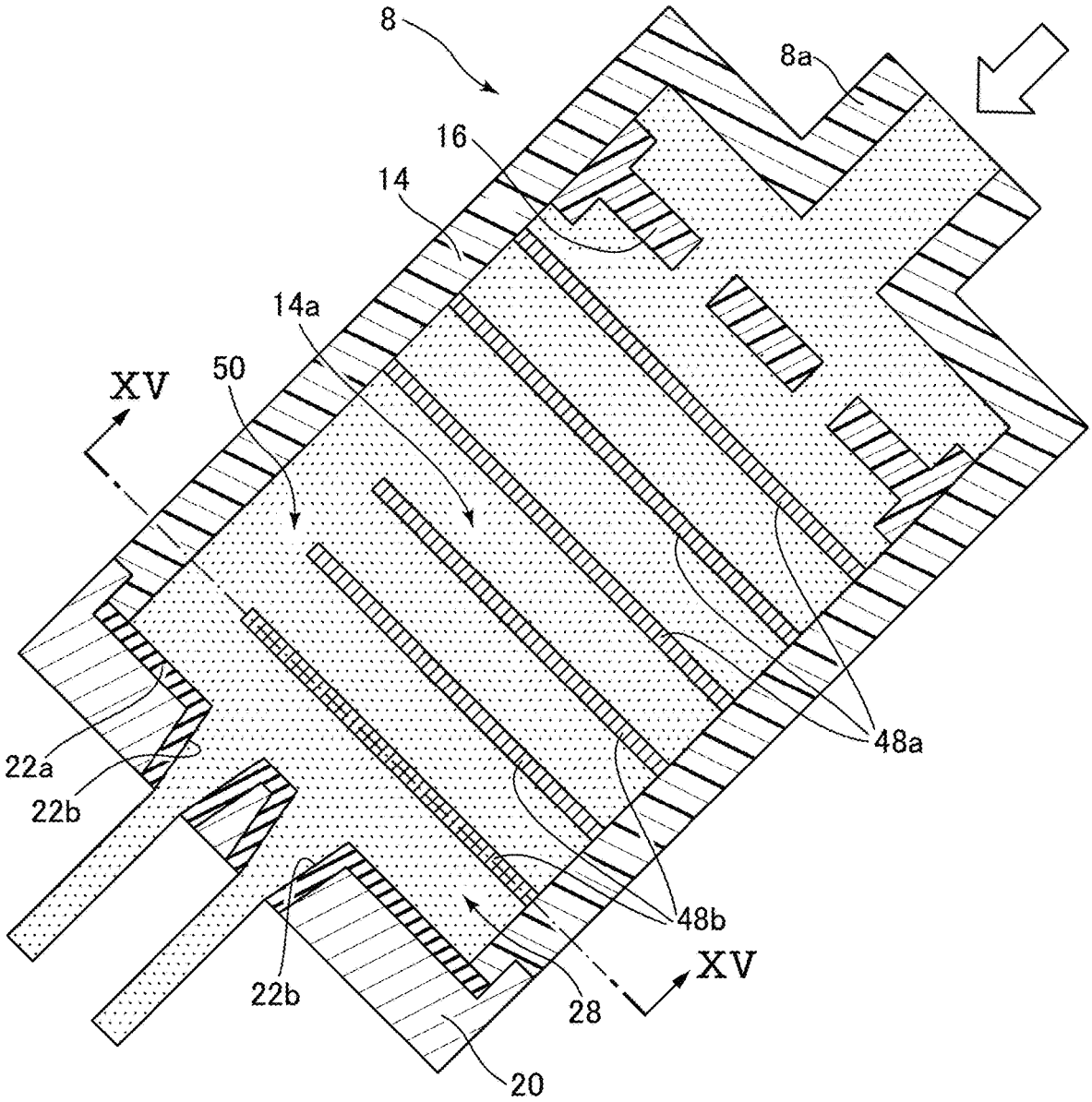
FIG. 14 is a view schematically illustrating an inside of a rectifying chamber of a water discharge device according to a modification example of the present invention.

As illustrated in FIG. 14, in the modification example, among the six meshes, three meshes 48*a* at an upstream side are not provided with cutout portions, and only three meshes 48*b* at a downstream side are provided with the cutout portions. Accordingly, an air bubble discharge flow path 50 is formed to be able to bypass only the three meshes 48*b* at the downstream side.

Figure 15:
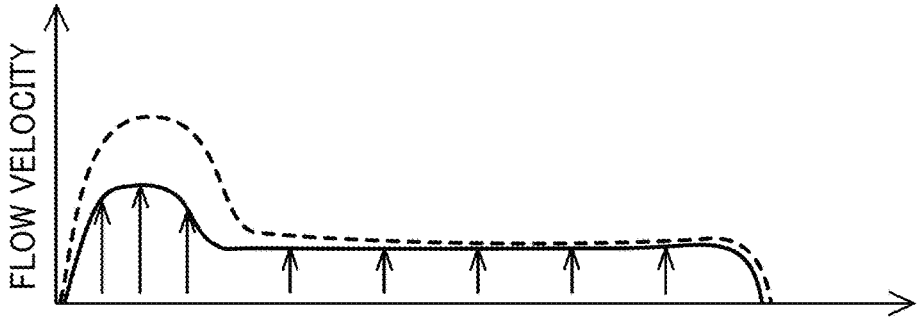
FIG. 15 is a diagram schematically illustrating a flow velocity distribution of water in the rectifying chamber of the water discharge device according to the modification example of the present invention.

FIG. 15 is a diagram schematically illustrating a flow velocity distribution of the water in a XV-XV section in FIG. 14. As illustrated by a solid line in FIG. 15, the flow velocity of the water in the XV-XV section is high in one end portion (a portion at a downstream end of the air bubble discharge flow path 50) where the mesh 48*b* is cutout. In the portion where the mesh 48*b* is cut out, the water flows in the air bubble discharge flow path 50 formed by the cutout, and does not passes through fine holes of the mesh 48*b*, so that the flow velocity becomes high.

A broken line in FIG. 15 schematically illustrates a flow velocity distribution in the same section in the case where all the six meshes 18 are provided with the cutout portions 18*b* as in the first embodiment (FIG. 12) of the present invention. As illustrated by the broken line in FIG. 15, in the case where all of the meshes 18 are provided with the cutout portions 18*b*, the flow velocity in the downstream end of the air bubble discharge flow path 26 is much higher. This is because the air bubble discharge flow path 26 is formed to bypass all the meshes 18, and the flow path resistance is smaller than the case of the modification example illustrated in FIG. 14.

Here, by providing the air bubble discharge flow path to bypass all the meshes, the discharge performance of the air bubbles in the rectifying chamber is enhanced, whereas presence of the portion with a high flow velocity in the rectifying chamber becomes a cause of worsening the rectifying performance of the rectifying device. By forming the air bubble discharge flow path 50 to be able to bypass only some of the provided meshes as in the modification example illustrated in FIG. 14, discharge performance of air bubbles and the rectifying performance can be made compatible in a well-balanced manner. In the case of the configuration capable of bypassing only some of the meshes, the air bubble discharge flow path is preferably provided to bypass the meshes disposed at the downstream side. That is, in the meshes where the air bubble discharge flow path is not provided, air bubbles are likely to stay, but the air bubbles staying in the meshes at the upstream side have a smaller influence on the rectifying performance as compared with those staying at the downstream side, and therefore have a smaller adverse effect on the flow of the water which is jetted than the air bubbles staying in the meshes at the downstream side.

While in the aforementioned embodiment, the air bubble discharge flow path 26 is formed by providing the cutout portions 18*b* in the meshes 18 which are the rectifying members, a flow path that bypasses the rectifying members may be additionally provided without providing the cutout portions in the rectifying members, and the flow path can be used as the air bubble discharge flow path. Further, opening portions are provided in the rectifying members, instead of providing the cutouts in the rectifying members, a flow path that allows the water to pass without passing the fine holes of the rectifying members is provided, and the flow path can be used as the air bubble discharge flow path.

Figure 16:
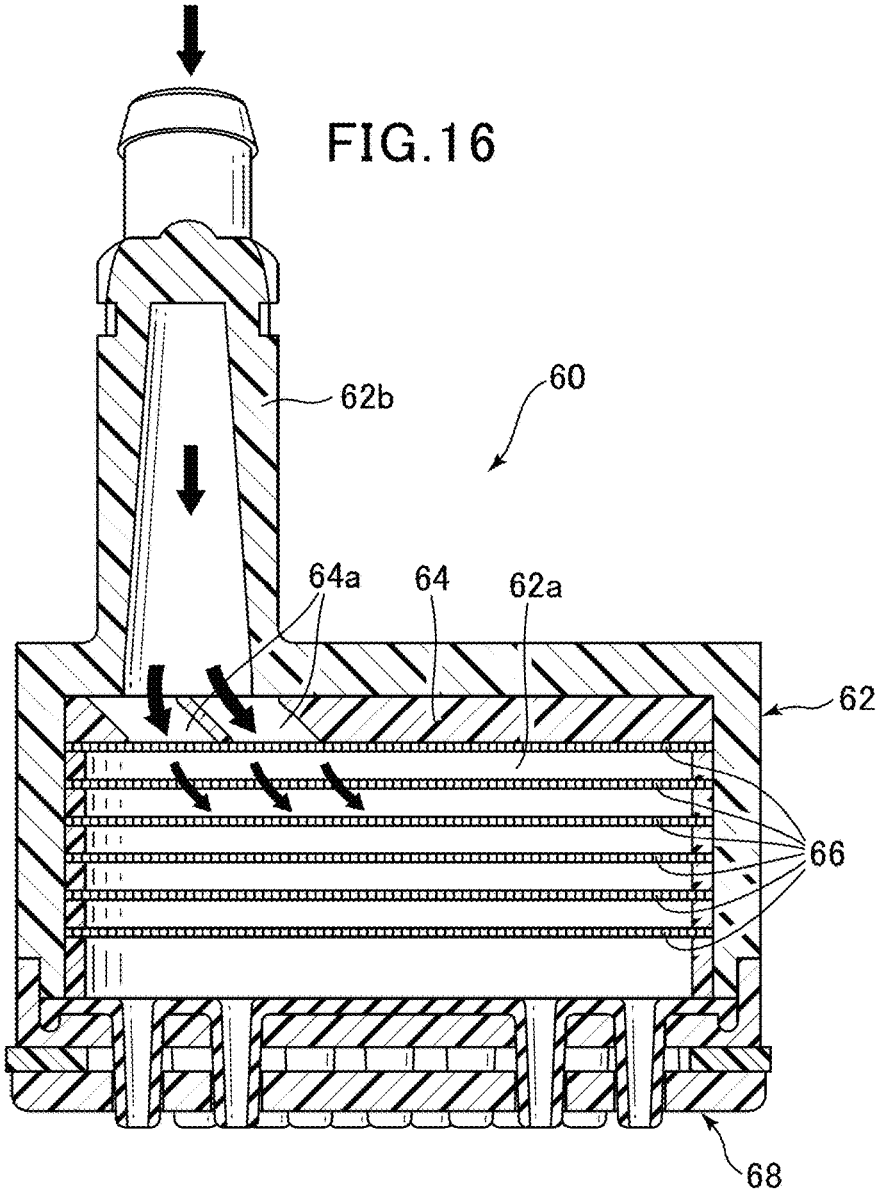
FIG. 16 is a sectional view illustrating a rectifying device of a water discharge device according to a second modification example of the present invention.
Figure 17:
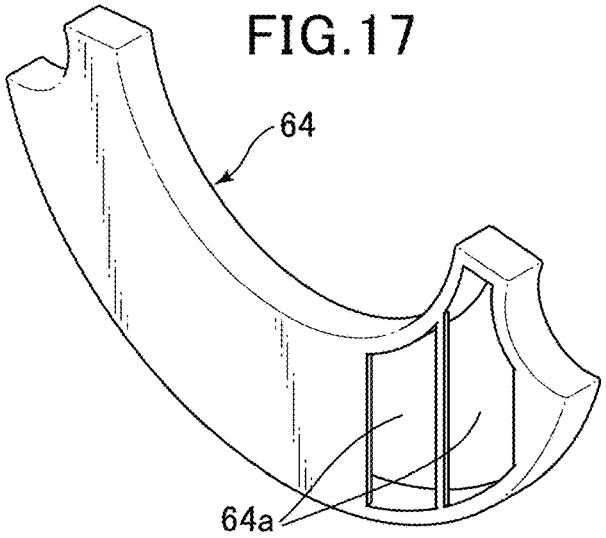
FIG. 17 is a perspective view illustrating a flow distributing plate disposed in an rectifying chamber of the water discharge device according to the second modification example of the present invention.

While in the aforementioned embodiment, the flow distributing plate 16 is formed of the plate-shaped member having a plurality of through-holes 16*a* for uniformizing the flow in the rectifying chamber 14*a*, the flow distributing plate can be given a function of directing the flow in the rectifying chamber, as a second modification example. FIG. 16 is a sectional view of a rectifying device including a flow distributing plate like this. FIG. 17 is a perspective view of the flow distributing plate included by a water discharge device of the present modification example.

As illustrated in FIG. 16, a rectifying device 60 in the present modification example has a rectifying device body 62, a flow distributing plate 64 housed in the rectifying device body 62, six meshes 66 that are rectifying members disposed at a downstream side of the flow distributing plate 64 and each formed into a plate shape, and a water spray member 68 that is disposed at a downstream side of these meshes 66 and is provided with a plurality of spray nozzles. Here, configurations of the mesh 66 and the water spray member 68 are similar to those in the aforementioned first embodiment, so that explanation thereof will be omitted.

The rectifying device body 62 is a resin member in which a rectifying chamber 62*a* having a section bent in a substantially arc shape is internally provided, and a water supply pipe connection portion 62*b* is formed at a left side of a rear end portion thereof. Thereby, the water supplied through a water supply pipe and the water supply pipe connection portion 62*b* flows into the left side rear end portion of the rectifying chamber 62*a*. A front end portion of the rectifying device body 62 is opened, and the flow distributing plate 64 and the respective meshes 66 are disposed inside the rectifying chamber 62*a* through the opening portion. The rectifying chamber 62*a* has a substantially constant flow path section from an upstream end to a downstream end, and the flow distributing plate 64 and the six meshes 66 are disposed therein.

The flow distributing plate 64 is a plate-shaped resin member formed into a shape that corresponds to a sectional shape of the rectifying chamber 62*a*, and is disposed to abut on an end portion wall surface at an upstream side of the rectifying chamber 62*a*. In the flow distributing plate 64, two through-holes 64*a* each with a substantially rectangular section are formed to penetrate through a plate surface of the flow distributing plate 64. These through-holes 64*a* are provided only in a position facing the water supply pipe connection portion 62*b* which causes the water to flow into the rectifying chamber 62*a*. As illustrated in FIG. 16 and FIG. 17, these through-holes 64*a* are formed to incline toward a center of the flow distributing plate 64, with respect to a plate surface of the flow distributing plate 64. Consequently, the water which is supplied from the water supply pipe through the water supply pipe connection portion 62*b* is directed toward the center from the left end of the upstream end of the rectifying chamber 62*a* by the through-holes 64*a* which are formed by being inclined, of the flow distributing plate 64, when the water flows into the rectifying chamber 62*a*. Thereby, even when the water is caused to flow in from the end portion of the rectifying chamber 62*a*, the water can be restrained from flowing unevenly to an end portion side of the rectifying chamber 62*a*, by the inclined through-holes 64*a* of the flow distributing plate 64. Further, the meshes 18 are disposed at intervals, whereby the flow can be distributed evenly in the rectifying chamber 62*a*.

REFERENCE SIGNS LIST

1 hand washer
2 water discharge device
4 washbowl
6 water discharge device body
8 rectifying device
8*a* water supply pipe connection portion
8*b* recessed portion
10 water supply pipe
12 human body detection sensor
12*a* signal line
14 rectifying device body
14*a* rectifying chamber
16 flow distributing plate
16*a* through-hole
16*b* space
18 mesh (rectifying member)
18*a* fine hole
18*b* cutout portion
20 water spray member
22 nozzle forming member
22*a* flat plate portion
22*b* spray nozzle
24 nozzle support member
26 air bubble discharge flow path
28 buffer space
30 stainless steel plate
32 water droplet
34 stainless steel plate
36 air bubble
38 air bubble by residual air
40 fine air bubble
42 grown air bubble
44 collision surface
46 air bubble retention portion
48*a* mesh
48*b* mesh
50 air bubble discharge flow path
60 rectifying device
62 rectifying device body
62*a* rectifying chamber
62*b* water supply pipe connection portion
64 flow distributing plate
64*a* through-hole

66 mesh

68 water spray member

What is claimed is:

1. A water discharge device for spraying water, comprising:

a water discharge device body;

a rectifying chamber provided in the water discharge device body to which the water is introduced;

a plurality of rectifying members each having a plurality of holes, the rectifying members being disposed at intervals in the rectifying chamber so that the water passes through the rectifying members;

a water spray member provided with a plurality of spray nozzles for discharging the water passing through the rectifying members; and an air bubble discharge flow path having cross section larger than each of the holes of the rectifying members, the air bubble discharge flow path is provided so that air bubbles which are larger than the holes of the rectifying members and are present between the rectifying members, are discharged from spaces between the rectifying members;

wherein a cutout portion is formed on an edge of at least one of the rectifying members, and the air bubble discharge flow path is formed by a gap between the cutout portion and an inner wall of the rectifying chamber;

wherein the intervals between the rectifying members are larger than the holes of the rectifying members, and the air bubbles in the spaces between the rectifying members flow through the air bubble discharge flow path and reach to the water spray member; and wherein the plurality of rectifying members are disposed by being inclined with respect to a horizontal line, and the air bubble discharge flow path is provided at an upper end side of the inclined rectifying members so that air bubbles in the space between the rectifying members reach to the air bubble discharge flow path by a buoyant force.

2. The water discharge device according to claim 1, wherein the cutout portion is formed in each of the rectifying members disposed at a downstream side in the rectifying chamber and at least one of the rectifying members disposed at an upstream side in the rectifying chamber does not have the cutout portion.

3. The water discharge device according to claim 1, wherein a buffer space is further provided between one of the rectifying members disposed at a most downstream side and the water spray member, and a downstream end of the air bubble discharge flow path communicates with the buffer space.

4. The water discharge device according to claim 3, wherein a collision surface is provided in the buffer space, and the water passed through the air bubble discharge flow path collides with the collision surface.

5. The water discharge device according to claim 1, wherein each of the spray nozzles is formed into a taper shape in which a cross section of the spray nozzles is narrowed toward a downstream side.

6. The water discharge device according to claim 1, wherein the air bubble discharge flow path is formed so that the air bubble discharge flow path bypasses the plurality of the rectifying members.

7. The water discharge device according to claim 1, wherein the rectifying members are flat wire meshes formed by weaving elemental wires.

8. The water discharge device according to claim 7, wherein dimensions in a vertical direction and a lateral direction of fine holes of the flat wire meshes are approximately 0.1 to 1.0 mm.

9. A water discharge device for spraying water, comprising:

a water discharge device body;

a rectifying chamber provided in the water discharge device body to which the water is introduced;

a plurality of rectifying members each having a plurality of holes, the rectifying members being disposed at intervals in the rectifying chamber so that the water passes through the rectifying members;

a water spray member provided with a plurality of spray nozzles for discharging the water passing through the rectifying members; and an air bubble discharge flow path having cross section larger than each of the holes of the rectifying members, the air bubble discharge flow path is provided so that air bubbles which are larger than the holes of the rectifying members and are present between the rectifying members, are discharged from spaces between the rectifying members;

wherein the intervals between the rectifying members are larger than the holes of the rectifying members, and the air bubbles in the spaces between the rectifying members flow through the air bubble discharge flow path and reach to the water spray member;

wherein a buffer space is further provided between one of the rectifying members disposed at a most downstream side and the water spray member, and a downstream end of the air bubble discharge flow path communicates with the buffer space;

wherein a collision surface is provided in the buffer space and is disposed to intersect the air bubble discharge flow path, and the water passed through the air bubble discharge flow path collides with the collision surface; and wherein the water spray member comprises a flat plate portion and water spray nozzles protruded from the flat plate portion in a discharge direction, the air bubble discharge flow path is terminated at an upstream side surface of the flat plate portion of the water spray member.

10. The water discharge device according to claim 9, wherein the air bubble discharge flow path is formed in each of the rectifying members disposed at a downstream side in the rectifying chamber and at least one of the rectifying members disposed at an upstream side in the rectifying chamber does not have the air bubble discharge flow path.

11. The water discharge device according to claim 9, wherein each of the spray nozzles is formed into a taper shape in which a cross section of the spray nozzles is narrowed toward a downstream side.

12. The water discharge device according to claim 9, wherein the collision surface is provided on the upstream side surface of the flat plate portion of the water spray member.

* * * * *